US009529284B2

(12) United States Patent
Tanaka et al.

(10) Patent No.: US 9,529,284 B2
(45) Date of Patent: Dec. 27, 2016

(54) PROCESS CARTRIDGE, IMAGE FORMING METHOD, AND ELECTROPHOTOGRAPHIC APPARATUS

(71) Applicant: CANON KABUSHIKI KAISHA, Tokyo (JP)

(72) Inventors: Daisuke Tanaka, Yokohama (JP); Kazumichi Sugiyama, Numazu (JP); Takeshi Murakami, Numazu (JP); Daisuke Kawaguchi, Toride (JP); Naoki Okamoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/949,295

(22) Filed: Nov. 23, 2015

(65) Prior Publication Data

US 2016/0154325 A1 Jun. 2, 2016

(30) Foreign Application Priority Data

Nov. 28, 2014 (JP) ..... 2014-242581

(51) Int. Cl.
*G03G 5/04* (2006.01)
*G03G 21/18* (2006.01)

(52) U.S. Cl.
CPC ..... *G03G 5/04* (2013.01); *G03G 21/1814* (2013.01)

(58) Field of Classification Search
USPC ..... 399/111
See application file for complete search history.

(56) References Cited

U.S. PATENT DOCUMENTS 4,734,735 A * 3/1988 Haneda ..... G03G 15/056 399/231
5,087,517 A 2/1992 Sagawa
5,349,426 A * 9/1994 Kudoh ..... G03G 21/105 399/350
5,517,289 A 5/1996 Ito
(Continued)

FOREIGN PATENT DOCUMENTS

JP H05210300 A 8/1993
JP H10207186 A 8/1998
(Continued)

OTHER PUBLICATIONS

U.S. Appl. No. 14/949,604, filed Nov. 23, 2015, Daisuke Kawaguchi.

(Continued)

*Primary Examiner* — Minh Phan
*Assistant Examiner* — Linda B Smith
(74) *Attorney, Agent, or Firm* — Canon U.S.A., Inc. IP Division

(57) ABSTRACT

A process cartridge includes an electrophotographic photosensitive member, a charging device, and a developing device. The electrophotographic photosensitive member has a surface layer containing a polyarylate resin and a polycarbonate resin. The electrophotographic photosensitive member has an outer diameter of 23 mm or less and the developing device is configured to collect a residual toner left on the electrophotographic photosensitive member. A toner has a weight-average particle diameter (D4) of 7.1 μm or more and 10.0 μm or less, an average circularity of 0.95 or more, and an average aspect ratio of 0.90 or more.

10 Claims, 2 Drawing Sheets

(56) References Cited

U.S. PATENT DOCUMENTS

| | | | | |
|---|---|---|---|---|
| 5,660,961 | A | 8/1997 | Yu | |
| 5,670,284 | A | 9/1997 | Kishi | |
| 6,355,390 | B1 | 3/2002 | Yamanami | |
| 7,556,903 | B2 | 7/2009 | Yanagawa | |
| 2001/0044063 | A1 | 11/2001 | Hamaguchi | |
| 2003/0113645 | A1 | 6/2003 | Suzuki | |
| 2003/0175605 | A1 | 9/2003 | Katayama | |
| 2003/0228172 | A1* | 12/2003 | Nakamura | G03G 15/0266 399/174 |
| 2004/0043315 | A1 | 3/2004 | Takiguchi | |
| 2004/0214100 | A1 | 10/2004 | Yu | |
| 2005/0069797 | A1 | 3/2005 | Niimi | |
| 2005/0100806 | A1 | 5/2005 | Hongo | |
| 2006/0008719 | A1 | 1/2006 | Niimi | |
| 2006/0240346 | A1 | 10/2006 | Toda | |
| 2008/0124641 | A1 | 5/2008 | Toriyama | |
| 2009/0010664 | A1 | 1/2009 | Nukada | |
| 2009/0060574 | A1 | 3/2009 | Shibata | |
| 2009/0142093 | A1* | 6/2009 | Sawada | G03G 9/0806 399/111 |
| 2009/0311011 | A1* | 12/2009 | Hayase | G03G 15/0921 399/277 |
| 2010/0021835 | A1 | 1/2010 | Akiyama | |
| 2011/0020739 | A1 | 1/2011 | Nakamura | |
| 2011/0269062 | A1 | 11/2011 | Tong | |
| 2011/0269063 | A1 | 11/2011 | Wu | |
| 2012/0008984 | A1 | 1/2012 | Kami | |
| 2012/0034556 | A1 | 2/2012 | Nebashi | |
| 2012/0051786 | A1 | 3/2012 | Katayama | |
| 2012/0052423 | A1 | 3/2012 | Maruyama | |
| 2012/0070188 | A1 | 3/2012 | Hirakoso | |
| 2012/0114375 | A1 | 5/2012 | Fujii | |
| 2012/0263499 | A1 | 10/2012 | Yamauchi | |
| 2013/0164671 | A1* | 6/2013 | Matsui | G03G 9/0802 430/123.56 |
| 2013/0323632 | A1 | 12/2013 | Fujii | |
| 2014/0038094 | A1 | 2/2014 | Hamaguchi | |
| 2014/0065529 | A1 | 3/2014 | Fujii | |
| 2014/0178809 | A1 | 6/2014 | Matsusaki | |
| 2015/0205218 | A1 | 7/2015 | Tsuji | |
| 2015/0241800 | A1 | 8/2015 | Tomono | |
| 2015/0241803 | A1 | 8/2015 | Ikari | |
| 2015/0331346 | A1 | 11/2015 | Yamauchi | |
| 2016/0026099 | A1 | 1/2016 | Tokimitsu | |

FOREIGN PATENT DOCUMENTS

| | | | |
|---|---|---|---|
| JP | H10312102 | A | 11/1998 |
| JP | 2002123046 | A | 4/2002 |
| JP | 2005140945 | A | 6/2005 |
| JP | 2007187771 | A | 7/2007 |
| JP | 2008070518 | A | 3/2008 |
| JP | 2008299020 | A | 12/2008 |

OTHER PUBLICATIONS

U.S. Appl. No. 14/949,257, filed Nov. 23, 2015, Kazumichi Sugiyama.

* cited by examiner

PROCESS CARTRIDGE, IMAGE FORMING METHOD, AND ELECTROPHOTOGRAPHIC APPARATUS

BACKGROUND OF THE INVENTION

Field of the Invention

The present invention relates to a process cartridge, an image forming method, and an electrophotographic apparatus.

Description of the Related Art

In typical electrophotographic processes, the surface of an electrophotographic photosensitive member is uniformly charged, a latent image is formed through exposure, the latent image is made visible as a toner image by being developed with a toner, the toner image is transferred onto a transfer material such as paper, and then the toner image is fixed on the transfer material to obtain a printed matter. A toner left on the electrophotographic photosensitive member without being transferred onto the transfer material is removed from the electrophotographic photosensitive member by a cleaning device. The cleaning device is, for example, a blade, a fur brush, or a roller.

In recent years, a so-called "cleanerless system" in which a toner left on an electrophotographic photosensitive member is collected by a developing device without using a cleaning device has been desired in view of miniaturization of electrophotographic apparatuses and ecology.

In a cleanerless system in which such a cleaning device is simply removed, defective images (so-called fogging images) tend to be formed due to charging failure caused by contamination of a charging member. To suppress the contamination of the charging member, Japanese Patent Laid-Open No. 2008-70518 discloses that a cleaning member is provided which cleans a charging member by rubbing the surface of the charging member. Japanese Patent Laid-Open Nos. 10-207186 and 10-312102 also disclose that the contamination of the charging member is suppressed by disposing a second contact charging member to control the polarity of a residual toner.

SUMMARY OF THE INVENTION

A process cartridge according to aspects of the present invention is detachably attachable to a main body of an electrophotographic apparatus. The process cartridge includes a cylindrical electrophotographic photosensitive member, a charging device that charges the electrophotographic photosensitive member, and a developing device that forms a toner image on the electrophotographic photosensitive member through development using a toner. The electrophotographic photosensitive member has a surface layer containing at least one selected from the group consisting of a polyarylate resin and a polycarbonate resin. The electrophotographic photosensitive member has an outer diameter of 23 mm or less. The developing device is configured to collect a residual toner left on the electrophotographic photosensitive member after the toner image has been transferred onto a transfer material. The toner has a weight-average particle diameter (D4) of 7.1 μm or more and 10.0 μm or less, an average circularity of 0.95 or more, and an average aspect ratio of 0.90 or more.

An image forming method according to aspects of the present invention includes a step of charging a cylindrical electrophotographic photosensitive member with a charging device, an electrostatic latent image-forming step of forming an electrostatic latent image on the charged electrophotographic photosensitive member, a developing step of forming a toner image on the electrophotographic photosensitive member by developing the electrostatic latent image with a toner, and a transfer step of transferring the toner image formed on the electrophotographic photosensitive member onto a transfer material via an intermediate transfer body or without using an intermediate transfer body. The electrophotographic photosensitive member has a surface layer containing at least one selected from the group consisting of a polyarylate resin and a polycarbonate resin. The electrophotographic photosensitive member has an outer diameter of 23 mm or less. In the developing step, a residual toner left on the electrophotographic photosensitive member after the transfer step is collected. The toner has a weight-average particle diameter (D4) of 7.1 μm or more and 10.0 μm or less, an average circularity of 0.95 or more, and an average aspect ratio of 0.90 or more.

An electrophotographic apparatus according to aspects of the present invention includes a cylindrical electrophotographic photosensitive member, a charging device that charges the electrophotographic photosensitive member, and a developing device that forms a toner image on the electrophotographic photosensitive member through development using a toner. The electrophotographic photosensitive member has a surface layer containing at least one selected from the group consisting of a polyarylate resin and a polycarbonate resin. The electrophotographic photosensitive member has an outer diameter of 23 mm or less. The developing device is configured to collect a residual toner left on the electrophotographic photosensitive member after the toner image has been transferred onto a transfer material. The toner has a weight-average particle diameter (D4) of 7.1 μm or more and 10.0 μm or less, an average circularity of 0.95 or more, and an average aspect ratio of 0.90 or more.

Further features of the present invention will become apparent from the following description of exemplary embodiments with reference to the attached drawings.

DESCRIPTION OF THE EMBODIMENTS

Figure 1:
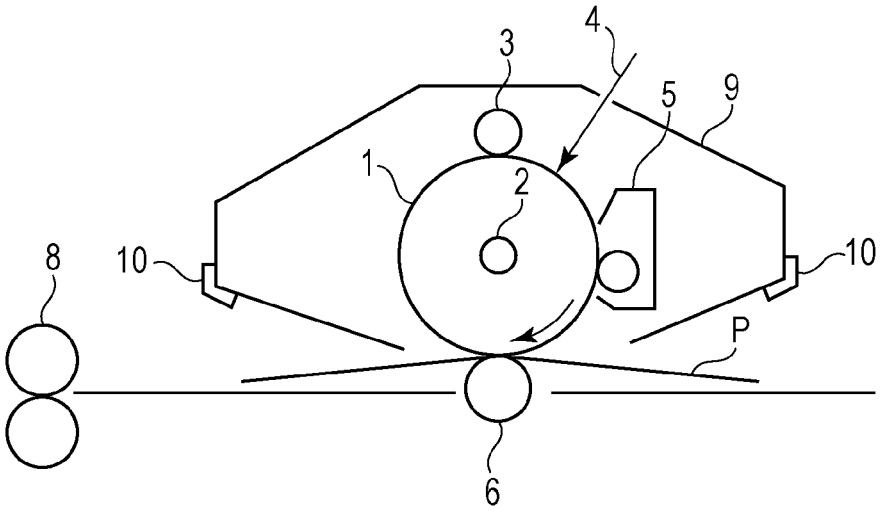
FIG. 1 illustrates an example of a schematic structure of an electrophotographic apparatus including a process cartridge that includes an electrophotographic photosensitive member according to an embodiment of the present invention.

In the methods disclosed in Japanese Patent Laid-Open Nos. 2008-70518, 10-207186, and 10-312102 that employ a cleanerless system, another member (cleaning member or second contact charging member) is provided, and thus the miniaturization of electrophotographic apparatuses is not sufficiently achieved.

As a result of further studies conducted by the present inventors, it has been found that when images are repeatedly formed with such a cleanerless system, a fogging image in which a toner image is developed on a white background tends to be formed. In particular, when the outer diameter of the electrophotographic photosensitive member is set to be 23 mm or less, the fogging image tends to be further formed.

The present invention is directed to providing a process cartridge, an image forming method, and an electrophotographic apparatus in which formation of fogging images is suppressed even if image formation is repeatedly performed using a cleanerless system in which a residual toner is collected by a developing device.

A process cartridge according to an embodiment of the present invention including an electrophotographic photosensitive member, a charging device, and a developing device has the following three features. First, the electrophotographic photosensitive member has a surface layer containing at least one selected from the group consisting of a polyarylate resin and a polycarbonate resin, and the outer diameter of the electrophotographic photosensitive member is 23 mm or less. Second, the developing device includes a cleanerless system that collects a residual toner left on the electrophotographic photosensitive member after a toner image is transferred onto a transfer material. Third, the toner has a weight-average particle diameter (D4) of 7.1 μm or more and 10.0 μm or less, an average circularity of 0.95 or more, and an average aspect ratio of 0.90 or more.

The present inventors assume, as follows, the reason for which formation of fogging images is suppressed by the above features even if image formation is repeatedly performed.

The observation of a toner in a developing device after repeated use has revealed that the proportion of an odd-form toner whose external shape is lost increases. Therefore, fogging images are assumed to be formed not only because charging failure which simply contaminates a charging device (charging member) occurs, but also because an odd-form toner whose external shape is lost is not provided with a sufficient charge amount (triboelectricity) and thus is developed as fogging images. Such an odd-form toner is classified into two types. First, an odd-form toner is originally contained in an unused developing agent. This odd-form toner is not appropriately provided with triboelectricity and is developed as fogging images. Second, an odd-form toner is easily broken because stress is easily applied thereto. Thus, the broken odd-form toner is not sufficiently provided with triboelectricity and is developed as fogging images. In particular, when the outer diameter of the electrophotographic photosensitive member is 23 mm or less, the curvature increases. Therefore, it is believed that linear load with devices (e.g., developing device and charging device) disposed around the electrophotographic photosensitive member increases, which increases the amount of the broken odd-form toner. Consequently, fogging images tend to be formed.

In an embodiment of the present invention, when a cleanerless system is employed using an electrophotographic photosensitive member having an outer diameter of 23 mm or less, the toner having the above-described third feature is used to further suppress the formation of fogging images due to an odd-form toner. By using such a toner, the proportion of an odd-form toner can be decreased. The detailed reason for this will be described later.

A process cartridge detachably attachable to an electrophotographic apparatus according to an embodiment of the present invention will be described below with reference to the attached drawings.

In FIG. 1, a cylindrical electrophotographic photosensitive member 1 is rotated about a shaft 2 at a predetermined peripheral speed in a direction indicated by an arrow.

The peripheral surface of the rotated electrophotographic photosensitive member 1 is uniformly charged at a predetermined positive or negative potential by a charging roller 3 (charging step). Subsequently, the electrophotographic photosensitive member 1 receives exposure light (image exposure light) 4 emitted from an exposure device (image exposure device, not illustrated) such as a slit exposure device or a laser beam scanning exposure device. Thus, electrostatic latent images corresponding to intended images are sequentially formed on the electrophotographic photosensitive member 1 (electrostatic latent image-forming step). The voltage applied to the charging roller 3 may be a direct voltage or may be a voltage obtained by superimposing direct voltage and alternating voltage.

The electrostatic latent images formed on the electrophotographic photosensitive member 1 are developed with a toner of a developing device 5 to form toner images (developing step). Subsequently, the toner images formed on the electrophotographic photosensitive member 1 are transferred onto a transfer material (e.g., paper) P by a transfer bias from a transfer device (e.g., transfer roller) 6 (transfer step). The transfer material P is fed to a portion (contact portion) between the electrophotographic photosensitive member 1 and the transfer device 6 from a transfer material feeding device (not illustrated) in synchronism with the rotation of the electrophotographic photosensitive member 1. Note that the toner images formed on the electrophotographic photosensitive member 1 may be transferred onto a transfer material P using an intermediate transfer body (e.g., intermediate transfer belt).

The transfer material P onto which the toner images have been transferred is separated from the peripheral surface of the electrophotographic photosensitive member 1 and is conveyed to a fixing device 8. After the toner images are fixed, the transfer material P is output from the electrophotographic apparatus as an image-formed article (a print or a copy).

The peripheral surface of the electrophotographic photosensitive member 1 after the toner images have been transferred is irradiated with pre-exposure light emitted from a pre-exposure device (not illustrated) to remove electricity, and then the electrophotographic photosensitive member 1 is repeatedly used for image forming. After the transfer step, the residual toner left on the electrophotographic photosensitive member is collected using the developing device of the following electrophotographic process by cleaning performed simultaneously with development.

In the cleaning performed simultaneously with development, a toner left on the photosensitive member after the transfer step is collected using the difference in potential between the toner left on the photosensitive member and the developing device. Therefore, the residual toner needs to be negatively charged. The pre-exposure light is effective to negatively charge a toner (residual toner).

The above-described electrophotographic photosensitive member 1, charging roller 3, and developing device 5 are integrally supported to constitute a process cartridge. The process cartridge is detachably attachable to a main body of an electrophotographic apparatus.

Figure 3:
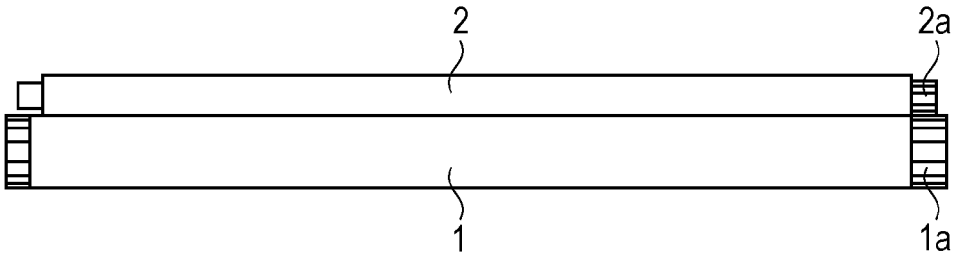
FIG. 3 illustrates a driving force transmission that transmits a driving force to the electrophotographic photosensitive member and a charging roller.

In an embodiment of the present invention, for example, a peripheral speed difference is generated between the electrophotographic photosensitive member 1 and the charging roller 3 because this is effective to negatively charge a residual toner. To generate the peripheral speed difference, the electrophotographic photosensitive member and the charging roller are integrated. There is a driving force transmission that transmits a driving force which causes rotation so that the contact portions of the electrophotographic photosensitive member and the charging roller move in the same direction and so that the peripheral speed of the charging roller is higher than that of the electrophotographic photosensitive member. As illustrated in FIG. 3, the driving force transmission includes an electrophotographic photosensitive member gear 1*a* held by the electrophotographic photosensitive member and a driven gear 2*a* held by the charging roller. The charging roller is driven together with the electrophotographic photosensitive member through a gear train from the electrophotographic photosensitive member gear 1*a* to the driven gear 2*a*. The peripheral speed difference is generated by controlling the gear ratio of the gears.

The toner and cylindrical electrophotographic photosensitive member used in an embodiment of the present invention will be described in detail.

Toner

In an embodiment of the present invention, the toner satisfies the following requirements.

The toner has a weight-average particle diameter (D4) of 7.1 μm or more and 10.0 μm or less, an average circularity of 0.95 or more, and an average aspect ratio of 0.90 or more.

If the toner has a weight-average particle diameter of less than 7.1 μm, the contact area and contact pressure for a transfer material (paper or intermediate transfer body) are not sufficiently high and thus the transfer efficiency decreases. In the cleanerless system, a low transfer efficiency results in contamination of a charging device and fogging images tend to be formed. If the toner has a weight-average particle diameter of more than 10.0 μm, it is difficult to provide an appropriate charge and fogging images tend to be formed from the beginning of use of an electrophotographic apparatus.

When the toner has a high average circularity, the toner has a shape close to a spherical shape, and consequently the contact area with the electrophotographic photosensitive member decreases. This advantageously affects the releasability from the electrophotographic photosensitive member when transfer is performed on a transfer material (paper or intermediate transfer body). In an embodiment of the present invention, the toner has an average circularity of 0.95 or more, such as 0.95 or more and 0.99 or less. In the case of the cleanerless system, as described above, a low transfer efficiency results in contamination of a charging device and fogging images tend to be formed.

The toner has an average aspect ratio of 0.90 or more. The presence percentage of odd-form toner can be expressed by using the average aspect ratio and the average circularity. The term "odd-form toner" used herein refers to a toner containing gourd-shaped toner particles each formed through coalescence of two toner particles. It is believed that the gourd-shaped toner tends to locally receive external pressure because of its shape and thus is easily broken unlike a spherical toner. In an electrophotographic process, the toner receives many pressures from the developing device, the transfer device, and the charging device, and thus the odd-form toner is easily broken. It is believed that the broken odd-form toner, as described above, is not sufficiently provided with triboelectricity and fogging images are formed. For example, the toner has an average aspect ratio of 0.90 or more and 0.95 or less.

By specifying both the average circularity and the average aspect ratio, the presence percentage of the odd-form toner can be expressed. When the presence percentage of the odd-form toner having, for example, a gourd-like shape increases, the average circularity increases and the average aspect ratio decreases. Assuming that, for example, 15% of a gourd-shaped odd-form toner in which two identical circles overlap with each other in an area of 10% is contained in the entire toner on a number basis, the toner has an average circularity of 0.95 and an average aspect ratio of 0.88.

The toner according to an embodiment of the present invention may be produced by a publicly known pulverization method and subjected to a publicly known surface treatment such as a thermal spheroidizing treatment or may be produced by a publicly known polymerization method. To achieve the above-described average circularity and average aspect ratio, for example, a suspension polymerization method described below is employed.

The toner according to an embodiment of the present invention is, for example, a toner produced by a method for producing toner particles, the method including a granulation process and a polymerization process. The granulation process is a process in which particles of a polymerizable monomer composition containing a polymerizable monomer, a coloring agent, and a polyester resin are formed in a first water-based medium containing a dispersion stabilizer A. The polymerization process is a process in which the polymerizable monomer contained in the particles of the polymerizable monomer composition is polymerized to obtain toner particles. The acid value of the polyester resin is 0.3 mgKOH/g or more and 1.5 mgKOH/g or less, and the toner contains 5.0 mass % or more and 20 mass % or less of the polyester resin based on the polymerizable monomer composition. The first water-based medium contains 1.5 mass % or more and 5.9 mass % or less of sodium chloride based on the polymerizable monomer composition.

In the method for producing toner particles according to an embodiment of the present invention, it is important that the acid value of the polyester resin is low and the content of the polyester resin in the polymerizable monomer composition is 5.0 mass % or more and 20 mass % or less for the purpose of producing a toner having a high average aspect ratio. It is believed that when the polyester resin having a low acid value is contained in a particular amount, the dispersibility of a coloring agent in the polymerizable monomer composition is improved in the granulation process and the polymerization process and thus the particles of the polymerizable monomer composition are stabilized in the water-based medium. Thus, formation of coalescent toner particles (odd-form toner having, for example, a gourd-like shape) is suppressed, and a toner having a high average aspect ratio is believed to be produced.

When a large amount of a polyester resin having a high acid value is contained, a broad particle size distribution tends to be obtained. It has been believed that a resin contained in the polymerizable monomer tends to be oriented at an interface between a water phase and an oil phase because of its high acid value and stabilizes particles. However, a high content of a resin having a high acid value sometimes degrades the dispersibility of a coloring agent in the polymerizable monomer composition and impairs the stability of droplets.

The content of the polyester resin having a low acid value is, for example, 5.0 mass % or more and 20 mass % or less based on the polymerizable monomer composition. By setting the content of the polyester resin within this range, the average aspect ratio of the toner is controlled to be 0.90 or more. Consequently, an increase in the viscosity of the polymerizable monomer composition is suppressed and good production stability is maintained.

For the purpose of suppressing formation of fine particles, it is important to control the content of the polyester resin having a low acid value and also to add 1.5 mass % or more and 5.9 mass % or less of sodium chloride based on the polymerizable monomer composition to the water-based medium. The addition of a particular amount of sodium chloride to the water-based medium produces a salting-out effect, which can suppress dissolution, in the water-based medium, of the polymerizable monomer contained in the particles of the polymerizable monomer composition. If the polymerizable monomer is dissolved in the water-based medium, a dispersion stabilizer adheres to the monomer and fine particles such as so-called emulsion particles are formed. Furthermore, the emulsion particles may cause the particles of the polymerizable monomer composition having a desired particle diameter to adhere to each other to form coalescent particles. In general, dispersion stabilizers generate a by-product salt in a water-based medium. However, it has been difficult to achieve both the salting-out effect produced by the by-product salt and the production of the toner particles having a desired particle diameter. The content of the sodium chloride is, for example, 1.5 mass % or more and 5.9 mass % or less because formation of fine particles and a decrease in the chargeability of the toner are suppressed.

The method for producing toner particles further includes a step of mixing the particles of the polymerizable monomer composition obtained in the granulation process with a second water-based medium, and the second water-based medium contains, for example, 5.0 mass % or more and 40 mass % or less of a dispersion stabilizer B based on the dispersion stabilizer A. When the second water-based medium contains the dispersion stabilizer B in the above-described amount, a dispersion stabilizer short in the granulation process is compensated and thus a toner having a higher average aspect ratio can be produced. When the content of the dispersion stabilizer B is 5.0 mass % or more and 40 mass % or less, a toner having a high average aspect ratio is produced. Furthermore, an increase in the number of fine particles due to adhesion of the dispersion stabilizer B to a volatile polymerizable monomer during the polymerization can be suppressed.

The dispersion stabilizer A is prepared by, for example, mixing an aqueous calcium chloride solution and an aqueous sodium phosphate solution. As expressed by formula (1) below, hydroxyapatite and sodium chloride, which is a by-product salt, are produced from calcium chloride and sodium phosphate. Hydroxyapatite is a dispersion stabilizer useful to stabilize the particles of the polymerizable monomer composition. Furthermore, since sodium chloride is produced as a by-product salt, the dispersion stabilizer A is desirably used to produce a salting-out effect that suppresses formation of fine particles in an embodiment of the present invention.

$$6Na_3Po_4+10CaCl_2+2H_2O \rightarrow [Ca_3(PO_4)_2]3Ca(OH)_2+18NaCl+2HCl \quad \text{Formula (1)}$$

The polymerizable monomer is, for example, a vinyl monomer, which is a radically polymerizable monomer. Examples of the vinyl monomer include monofunctional monomers and polyfunctional monomers.

Examples of the monofunctional monomer include styrene; styrene derivatives such as α-methylstyrene, β-methylstyrene, o-methylstyrene, m-methylstyrene, p-methylstyrene, p-methoxystyrene, and p-phenylstyrene; acrylic polymerizable monomers such as methyl acrylate, ethyl acrylate, n-propyl acrylate, iso-propyl acrylate, n-butyl acrylate, dibutyl phosphate ethyl acrylate, and 2-benzoyloxy ethyl acrylate; methacrylic polymerizable monomers such as methyl methacrylate, ethyl methacrylate, and dibutyl phosphate ethyl methacrylate; esters of methylene aliphatic monocarboxylic acids; vinyl esters such as vinyl acetate and vinyl propionate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone. Among them, styrene or a styrene derivative is particularly contained.

Examples of the polyfunctional monomer include diethylene glycol diacrylate, triethylene glycol diacrylate, tetraethylene glycol diacrylate, polyethylene glycol diacrylate, tetramethylolmethane tetramethacrylate, divinylbenzene, and divinyl ethers.

The monofunctional monomers may be used alone or in combination of two or more. Alternatively, the monofunctional monomers and the polyfunctional monomers may be used in combination. The polyfunctional monomer can also be used as a crosslinking agent.

A polymerization initiator is used to polymerize the polymerizable monomer. An oil-soluble initiator and/or a water-soluble initiator is used as the polymerization initiator. For example, a polymerization initiator whose half life is 0.5 to 30 hours at a reaction temperature during the polymerization reaction is used. Furthermore, for example, when the amount of the polymerization initiator added is 0.5 to 20 parts by mass based on 100 parts by mass of the polymerizable monomer, a polymer having a maximum peak between molecular weights of 10,000 and 100,000 is normally obtained in the polymerization reaction, and thus toner particles having appropriate strength and melting properties can be obtained.

Examples of the polymerization initiator include azo- or diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators such as benzoyl peroxide, t-butyl peroxy-2-ethylhexanoate, t-butyl peroxypivalate, t-butyl peroxyisobutylate, t-butyl peroxyneodecanoate, methyl ethyl ketone peroxide, diisopropylperoxy carbonate, cumene hydroperoxide, 2,4-dichlorobenzoyl peroxide, and lauroyl peroxide.

In order to control the degree of polymerization of the polymerizable monomer, a publicly known chain transfer agent or polymerization inhibitor or the like may be further added.

In an embodiment of the present invention, the polymerizable monomer composition contains, for example, a polyester resin. Such a polyester resin is exemplified below. A polyester resin contains a component (structure) derived from a divalent acid and a component (structure) derived from a dihydric alcohol.

The divalent acid is, for example, dicarboxylic acid or a derivative thereof described below. Examples of the divalent acid include benzenedicarboxylic acids, anhydrides thereof, and lower alkyl esters thereof, such as phthalic acid, terephthalic acid, isophthalic acid, and phthalic anhydride; alkyldicarboxylic acids, anhydrides thereof, and lower alkyl esters thereof, such as succinic acid, adipic acid, sebacic acid, and azelaic acid; alkenylsuccinic acids and alkylsuccinic acids, anhydrides thereof, and lower alkyl esters thereof, such as n-dodecenylsuccinic acid and n-dodecylsuccinic acid; and unsaturated dicarboxylic acids, anhydrides thereof, and lower alkyl esters thereof, such as fumaric acid, maleic acid, citraconic acid, and itaconic acid.

Examples of the dihydric alcohol include ethylene glycol, polyethylene glycol, 1,2-propanediol, 1,3-propanediol, 1,6-hexanediol, neopentyl glycol, 1,4-cyclohexanedimethanol (CHDM), hydrogenated bisphenol A, and bisphenols represented by formula (1) and derivatives thereof.

(1)

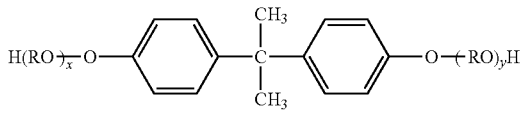

In the formula, R represents an ethylene group or a propylene group, x and y each represent an integer of 0 or more, and the average of x+y is 0 or more and 10 or less.

The polyester resin may contain a component other than the component derived from a divalent acid and the component derived from a dihydric alcohol. Examples of the component other than the above-described components include a component derived from a monovalent carboxylic acid, a component derived from a monohydric alcohol, a component derived from a trivalent or higher-valent carboxylic acid, and a component derived from a trihydric or higher-hydric alcohol.

Examples of the monovalent carboxylic acid include aromatic carboxylic acids having 30 or less carbon atoms, such as benzoic acid and p-methylbenzoic acid; and aliphatic carboxylic acids having 30 or less carbon atoms, such as stearic acid and behenic acid. Examples of the trivalent or higher-valent carboxylic acid include trimellitic acid, trimellitic anhydride, and pyromellitic acid.

Examples of the monohydric alcohol include aromatic alcohols having 30 or less carbon atoms, such as benzyl alcohol; and aliphatic alcohols having 30 or less carbon atoms, such as lauryl alcohol, cetyl alcohol, stearyl alcohol, and behenyl alcohol. Examples of the trihydric or higher-hydric alcohol include trimethylolpropane, pentaerythritol, and glycerin.

A method for producing the polyester resin is not particularly limited, and the polyester resin can be produced by a publicly known method.

In an embodiment of the present invention, the polymerizable monomer composition may contain a wax serving as a release agent.

From the viewpoint of releasability, the wax is, for example, a hydrocarbon wax such as a low-molecular-weight polyethylene, a low-molecular-weight polypropylene, a microcrystalline wax, or a paraffin wax. When necessary, two or more waxes may be used in combination.

Specific examples of the wax include VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD.); UNILIN (registered trademark) 350, 425, 550, and 700 and UNICID (registered trademark) 350, 425, 550, and 700 (TOYO ADL Corporation); and Japan tallow, beeswax, rice wax, candelilla wax, and carnauba wax (available from CERARICA NODA Co., Ltd).

The amount of the wax added is, for example, 1 part by mass or more and 20 parts by mass or less based on a binder resin.

The toner particles may be magnetic toner particles or non-magnetic toner particles.

In the case where the toner particles are produced as magnetic toner particles, for example, a magnetic iron oxide is used as a magnetic material. The magnetic iron oxide is iron oxide such as magnetite, maghematite, or ferrite. The amount of the magnetic iron oxide contained in the toner is, for example, 25 parts by mass or more and 100 parts by mass or less based on 100 parts by mass of the binder resin.

In the case where the toner particles are produced as non-magnetic toner particles, carbon black or a publicly known pigment or dye may be used as a coloring agent. The pigments and dyes may be used alone or in combination of two or more. The amount of the coloring agent contained in the toner is preferably 0.1 parts by mass or more and 60 parts by mass or less and more preferably 0.5 parts by mass or more and 50 parts by mass or less based on 100 parts by mass of the binder resin.

In the method for producing toner particles by a suspension polymerization method, for example, a publicly known charge control agent, conductivity-imparting agent, lubricant, or abrasive may be added in addition to the above-described materials.

In the production of the toner particles, these additives are uniformly dissolved or dispersed to prepare a polymerizable monomer composition. Subsequently, the polymerizable monomer composition is dispersed in a water-based medium containing a dispersion stabilizer using an appropriate stirrer. When necessary, an aromatic solvent and a polymerization initiator are added. A polymerization reaction is performed to obtain toner particles having a desired particle diameter.

After the completion of the polymerization of the toner particles, filtration, washing, and drying are performed by publicly known methods. When necessary, an inorganic fine powder serving as a fluidity improver is mixed so as to adhere to the surfaces of the toner particles. Thus, a toner can be produced.

A publicly known inorganic fine powder may be used. Examples of the inorganic fine powder include titania fine particles, silica fine particles of wet-process silica and dry-process silica, and inorganic fine powders prepared by surface-treating the silica fine particles with a silane coupling agent, a titanium coupling agent, a silicone oil, or the like. The inorganic fine powder subjected to such a surface treatment has, for example, a hydrophobicity of 30 or more and 98 or less, which is measured by titration of a methanol titration test.

Measurement method for weight-average particle diameter (D4)

The weight-average particle diameter (D4) of the toner is determined as follows. That is, the measurement is performed using a precision particle distribution analyzer "COULTER COUNTER Multisizer 3" based on an aperture impedance method and equipped with a 100 μm aperture tube (registered trademark, manufactured by Beckman Coulter, Inc.) with the number of effective measuring channels being 25,000. The measured data is analyzed using dedicated software "Beckman Coulter Multisizer 3, Version 3.51" (available from Beckman Coulter, Inc.) included in the analyzer for setting the measurement conditions and analyzing the measurement data to calculate the weight-average particle diameter (D4).

An aqueous electrolyte solution usable for the measurement can be prepared by dissolving special-grade sodium chloride in ion-exchanged water in a concentration of about 1 mass %. For example, "ISOTON II" (manufactured by Beckman Coulter, Inc.) can be used.

The dedicated software is configured as follows before measurement and analysis. In the "Changing Standard Operating Mode (SOM)" screen of the dedicated software, "Total Count" of "Control Mode" is set to 50,000 particles. "Number of Runs" is set to 1. "Kd value" is set to a value obtained by using "Standard particle 10.0 μm" (available from Beckman Coulter, Inc.). Pressing the "Threshold/Noise Level Measuring Button" automatically sets the threshold and the noise level. "Current" is set to 1600 μA. "Gain" is set to 2. "Electrolyte" is set to ISOTON II. A check mark is placed in "Flush aperture tube after measurement". In the "Convert Pulses to Size Setting" screen of the dedicated software, "Bin Interval" is set to logarithmic particle diameter. "Particle Diameter Bin" is set to 256 particle diameter bins. "Particle Diameter Range" is set in the range from 2 μm to 60 μm.

The specific measurement procedure is as follows.

1. Into a 250-mL glass round-bottom beaker dedicated for Multisizer 3, about 200 mL of the aqueous electrolyte solution is inserted. The beaker is set to a sample stand. Stirring is performed counterclockwise with a stirrer rod at a speed of 24 rotations per second. The "Aperture Flush" function in the dedicated software is used to remove contaminants and air bubbles from the aperture tube.

2. Into a 100-mL glass flat-bottom beaker, about 30 mL of the aqueous electrolyte solution is inserted. To the beaker, about 0.3 mL of a dilute solution is added as a dispersant, the dilute solution being prepared by diluting "Contaminon N" (a 10 mass % aqueous solution of a neutral (pH 7) cleanser for cleaning precision analyzers, the solution containing a nonionic surfactant, an anionic surfactant, and an organic builder, available from Wako Pure Chemical Industries, Ltd.) 3 times by mass with ion-exchanged water.

3. A predetermined amount of ion-exchanged water is inserted into a water tank of an "Ultrasonic Dispersion System Tetora 150" (manufactured by Nikkaki Bios Co., Ltd.) having an electrical output of 120 W and equipped with two oscillators each having an oscillation frequency of 50 kHz at a phase offset of 180 degrees. Then, about 2 mL of Contaminon N is added to the water tank.

4. The beaker prepared in the process 2 is set in a beaker-securing hole of the ultrasonic dispersion system, and the system is operated. The beaker height position is adjusted so that the resonance state of the liquid surface of the aqueous electrolyte solution in the beaker is maximized.

5. To the aqueous electrolyte solution in the beaker in the process 4, about 10 mg of a toner is gradually added while the aqueous electrolyte solution is irradiated with ultrasonic waves, so that the toner is dispersed in the solution. The ultrasonic dispersion treatment is continued for another 60 seconds. The ultrasonic dispersion is appropriately controlled in such a manner that the water temperature in the water tank is 10° C. or higher and 40° C. or lower.

6. The aqueous electrolyte solution containing the toner dispersed therein in the process 5 is added dropwise with a pipette to the round-bottom beaker set in the sample stand in the process 1 so that the measurement concentration is adjusted to about 5%. The measurement is continued until the number of measured particles reaches 50,000.

7. The measurement data is analyzed using the dedicated software included in the system to calculate each average particle diameter. When "Graph/Vol %" is selected in the dedicated software, "Arithmetic Diameter" and "50% D Diameter" on the "Analysis/Volume Statistics" screen respectively indicate the weight-average particle diameter D4 and D50. The number-average particle diameter D1 is also calculated in the same manner.

Measurement Method for Aspect Ratio and Small-Particle Ratio

The average circularity of the toner is measured with a flow-type particle image analyzer "FPIA-3000" (manufactured by Sysmex Corporation) under the measurement and analysis conditions used in the calibration process.

The specific measurement method is described below. First, about 20 mL of ion-exchanged water from which solid impurities and the like have been removed is inserted into a glass vessel. To the vessel, about 0.2 mL of a dilute solution is added as a dispersant, the dilute solution being prepared by diluting "Contaminon N" about 3 times by mass with ion-exchanged water. Then, about 0.02 g of the measurement sample is added thereto. The mixture is subjected to a dispersion treatment for 2 minutes with an ultrasonic disperser, thereby preparing a dispersion liquid for measurement. Here, the dispersion liquid is appropriately cooled so as to have a temperature of 10° C. or higher and 40° C. or lower. A desktop ultrasonic cleaner/disperser (for example, "VS-150", manufactured by Velvo-Clear) having an oscillation frequency of 50 kHz and an electrical output of 150 W is used as the ultrasonic disperser. A predetermined amount of ion-exchanged water is inserted into the water tank, and then about 2 mL of Contaminon N is added to the water tank.

Measurement is performed with the flow-type particle image analyzer equipped with "LUCPLFLN" (magnification: 20×, numerical aperture: 0.40) as an objective lens. A particle sheath "PSE-900A" (manufactured by Sysmex Corporation) is used as a sheath solution. The dispersion liquid prepared by the procedure described above is introduced into the flow-type particle image analyzer. In the HPF measurement mode, 2000 toner particles are measured using the total count mode. The binarization threshold during particle analysis is set to 85%. The analyzed particle diameter is limited to a circle-equivalent diameter of 1.977 μm or more and less than 39.54 μm. Thus, the average aspect ratio and small-particle ratio of the toner are determined.

In this measurement, automatic focal point adjustment is performed before the start of measurement using standard latex particles (for example, latex particles prepared by diluting, with ion-exchanged water, "RESEARCH AND TEST PARTICLES Latex Microsphere Suspensions 5100A" manufactured by Duke Scientific). After that, for example, focal point adjustment is performed every two hours after the start of measurement.

In this embodiment, a flow-type particle image analyzer for which the calibration work has been performed by Sysmex Corporation and for which a calibration certification has been issued by Sysmex Corporation is used. Measurement is performed under the measurement and analysis conditions at the time when the calibration certificate has been issued, except that the diameters of particles analyzed are limited to a circle-equivalent diameter of 1.977 μm or more and less than 39.54 μm.

Measurement of Tg of Resin

The glass transition temperature Tg of a resin is measured with a differential scanning calorimeter "Q2000" (manufactured by TA Instruments) in conformity with ASTM D 3418-82. The melting points of indium and zinc are used for the temperature correction of a detection unit of the calorimeter. The heat of fusion of indium is used for the correction of the amount of heat. Specifically, about 2 mg of a measurement sample is accurately weighed and placed into an aluminum pan. An empty aluminum pan is used as a reference. Measurement is performed in the temperature range of 30° C. to 200° C. at a temperature-increasing rate of 10° C./min. In this measurement, the temperature is increased to 200° C. once, then decreased to 30° C., and again increased. In the second temperature increase process, a change in specific heat is obtained in the temperature range of 40° C. to 100° C. The point of intersection between the differential thermal curve and an intermediate line of baselines before and after the change in specific heat is defined as the glass transition temperature Tg of the resin.

Measurement of Softening Point of Resin

The softening point of a resin is measured using a constant test force extrusion-type capillary rheometer "Flow Characteristics Evaluation Instrument, Flow Tester CFT-500D" (manufactured by SHIMADZU CORPORATION) in accordance with the manual included with the tester. In this instrument, the measurement sample filling a cylinder is melted by performing heating and extruded from a die located at the bottom of the cylinder while a constant load is applied onto the measurement sample by a piston. A flow curve that shows the relationship between the downward displacement of the piston and the temperature can be obtained.

The "melting temperature by the ½ method" described in the manual included with the "Flow Characteristics Evaluation Instrument, Flow Tester CFT-500D" is defined as the softening point. The melting temperature by the ½ method is calculated as follows. First, the half value (X) of the difference between the downward displacement Smax of the piston at the time when the sample has flowed out completely and the downward displacement Smin of the piston at the time when the sample has started flowing is determined ($X=(Smax-Smin)/2$). The temperature at which the downward displacement of the piston is equal to the sum of X and Smin in the flow curve is defined as the melting temperature by the ½ method.

The measurement sample is prepared by compacting about 1.0 g of a sample into a cylindrical tablet having a diameter of about 8 mm using a tablet machine (e.g., NT-100H manufactured by NPa System Co., Ltd.) at about 10 MPa for about 60 seconds in an environment of 25° C.

The measurement conditions of CFT-500D are as follows.

Test mode: Temperature-increasing method

Temperature-increasing rate: 4° C./min

Start temperature: 50° C.

End temperature: 200° C.

Measurement of Acid Value of Resin

The acid value of a resin refers to the milligrams of potassium hydroxide required to neutralize an acid contained in 1 g of a sample. The acid value of a polyester resin is measured in conformity with JIS K 0070-1992. Specifically, the measurement is performed through the following procedure.

(1) Preparation of Reagents

A phenolphthalein solution is prepared by dissolving 1.0 g of phenolphthalein in 90 mL of ethyl alcohol (95 vol %) and adding ion-exchanged water thereto so as to have a volume of 100 ml.

In 5 mL of water, 7 g of special grade potassium hydroxide is dissolved, and ethyl alcohol (95 vol %) is added until the total volume comes to 1 L. The mixture is left to stand for three days in an alkali-resistant container so as not to come into contact with carbon dioxide or the like. The mixture is filtered and thus a potassium hydroxide solution is prepared. The prepared potassium hydroxide solution is stored in an alkali-resistant container. The factor of the potassium hydroxide solution is determined from the amount of the potassium hydroxide solution required for neutralization which is performed by inserting 25 mL of 0.1 mol/L hydrochloric acid into an Erlenmeyer flask, adding several drops of the phenolphthalein solution thereto, and performing titration with the potassium hydroxide solution. The 0.1 mol/L hydrochloric acid is prepared in conformity with JIS K 8001-1998.

(2) Operation (A) Main Test

In a 200 mL Erlenmeyer flask, 2.0 g of a pulverized polyester resin sample is precisely weighed, and 100 mL of a toluene/ethanol (2:1) mixed solution is added to the Erlenmeyer flask and the sample is dissolved over 5 hours. Subsequently, several drops of the phenolphthalein solution are added as an indicator, and the resulting solution is titrated with the potassium hydroxide solution. The end point of the titration is a point at which the indicator turns pink and the pink color is kept for about 30 seconds.

(B) Blank Test

The same titration as in the above operation is performed, except that only a toluene/ethanol (2:1) mixed solution not containing the sample is used.

(3) The acid value is calculated by substituting the obtained result into the following formula.

$$A=[(C-B)\times f\times 5.61]/S$$

In the formula, A represents the acid value (mgKOH/g), B represents the amount (mL) of the potassium hydroxide solution added in the blank test, C represents the amount (mL) of the potassium hydroxide solution added in the main test, f represents the factor of the potassium hydroxide solution, and S represents the weight of the sample (g).

Next, an electrophotographic photosensitive member used in an embodiment of the present invention will be described.

The outer diameter of the electrophotographic photosensitive member is 23 mm or less, preferably 20 mm or less, and more preferably 10 mm or more and 20 mm or less. In an embodiment of the present invention, the outer diameter of the electrophotographic photosensitive member is determined as an outer diameter of a support. Since coating films such as a photosensitive layer and a surface layer on the support are sufficiently thin films with a thickness of several micrometers to several tens of micrometers, such coating films are not considered when the outer diameter of the electrophotographic photosensitive member is determined.

The surface layer of the electrophotographic photosensitive member contains at least one selected from the group consisting of a polycarbonate resin and a polyarylate resin.

The polyarylate resin has, for example, a structural unit represented by formula (B) below.

(B)

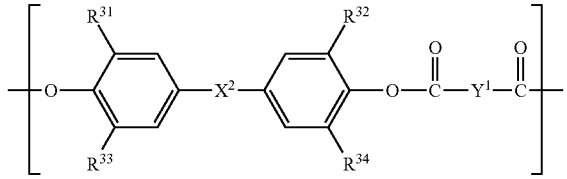

In the formula (B), $R^{31}$ to $R^{34}$ each independently represent a hydrogen atom or a methyl group; $X^2$ represents a single bond, a cyclohexylidene group, or a divalent group having a structure represented by formula (C) below; and $Y^1$ represents a m-phenylene group, a p-phenylene group, or a divalent group in which two p-phenylene groups are bonded to each other with an oxygen atom located therebetween.

(C)

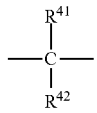

In the formula (C), $R^{41}$ and $R^{42}$ each independently represent a hydrogen atom, a methyl group, or a phenyl group.

Specific examples of the structural unit represented by the formula (B) are shown below.

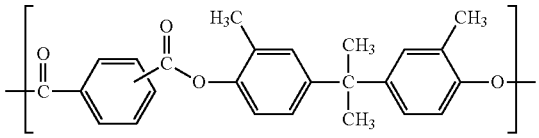

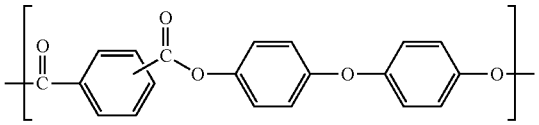

-continued

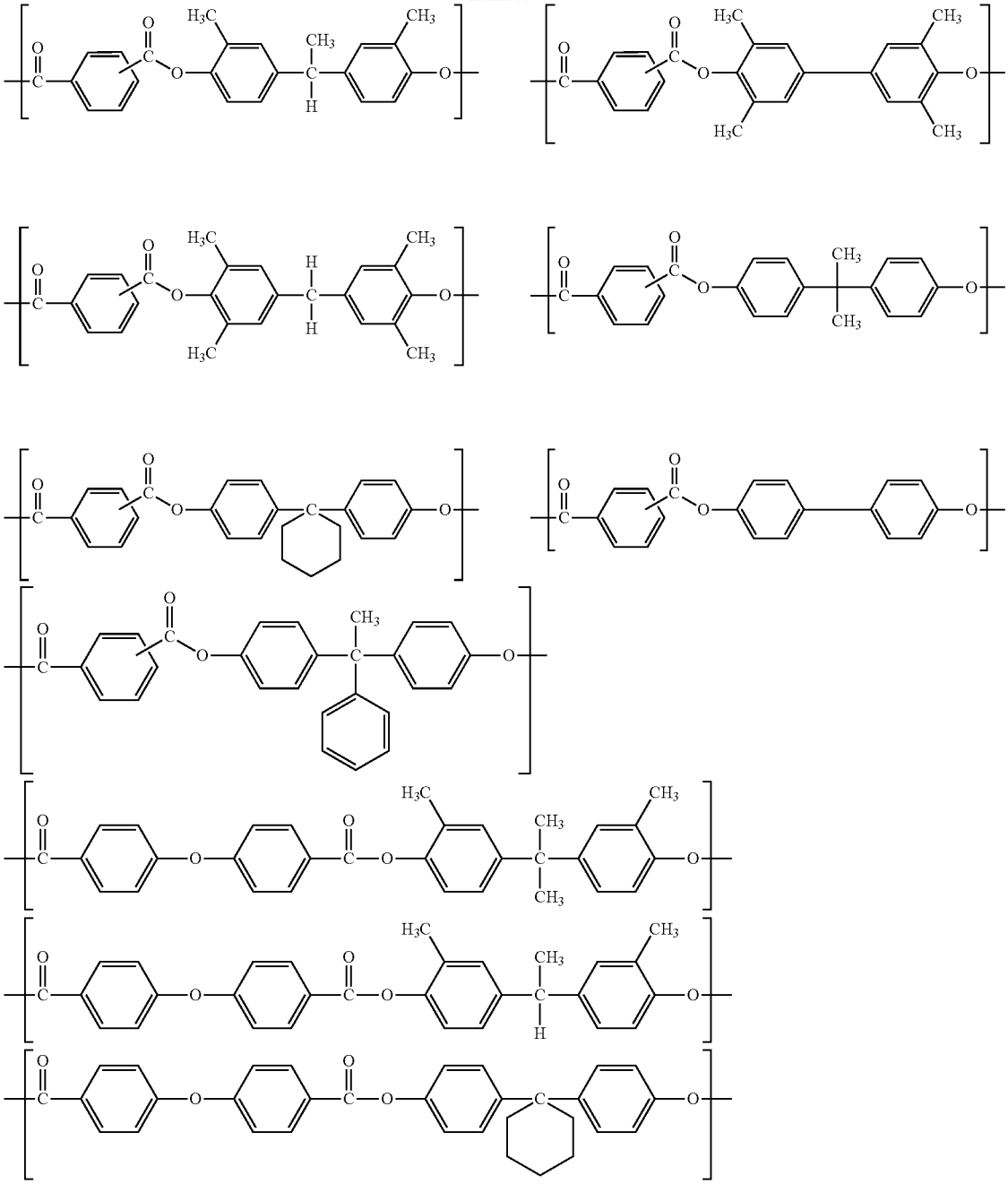

In an embodiment of the present invention, the outer diameter of the electrophotographic photosensitive member is 23 mm or less. The number of rotations of the electrophotographic photosensitive member increases to print the required number of sheets, and thus a polyarylate resin is used in view of the amount of abrasion and scratch resistance. In particular, when an electrophotographic apparatus including a cleanerless system is employed, a scraped powder generated due to abrasion of a surface layer of the electrophotographic photosensitive member easily causes the contamination of a charging member. A polyarylate resin is desirably used because use of a polyarylate resin does not easily cause charging failure due to the contamination of a charging member.

The polycarbonate resin has, for example, a structural unit represented by formula (A) below.

(A)

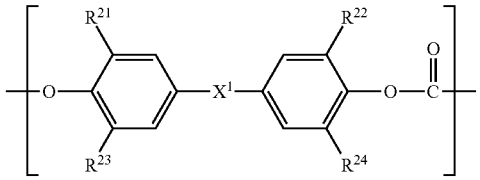

In the formula (A), $R^{21}$ to $R^{24}$ each independently represent a hydrogen atom or a methyl group, $X^1$ represents a single bond, a cyclohexylidene group, or a divalent group having a structure represented by formula (C) below.

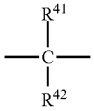

(C)

In the formula (C), $R^{41}$ and $R^{42}$ each independently represent a hydrogen atom, a methyl group, or a phenyl group.

Specific examples of the structural unit represented by the formula (A) are shown below.

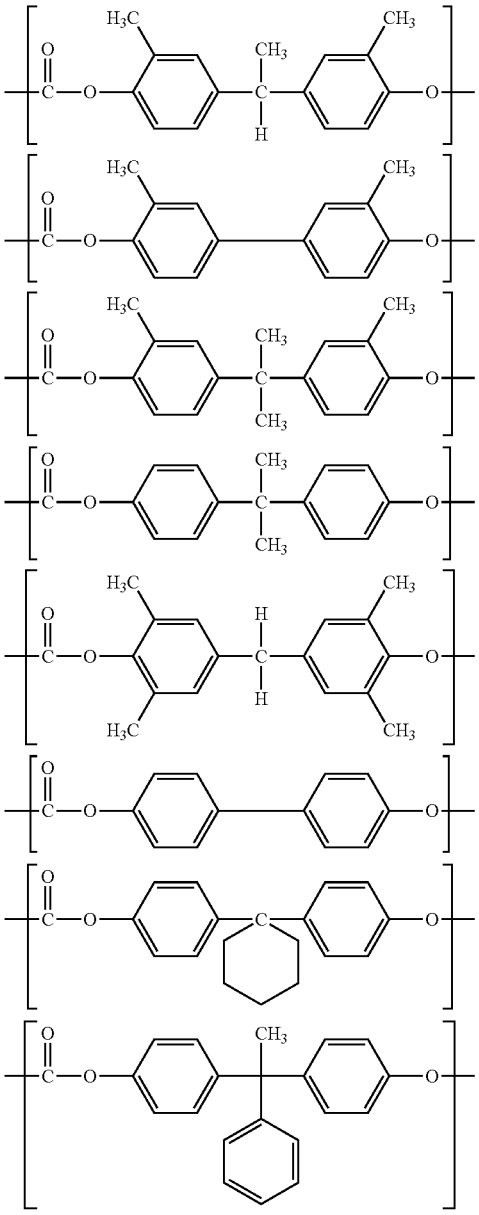

-continued

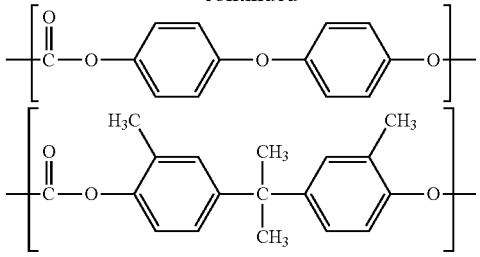

Furthermore, the surface layer contains, for example, a polycarbonate resin or a polyarylate resin having a moiety with a siloxane structure because a residual toner is easily collected by a developing device. This may be related to triboelectric series. A toner positively charged by a transfer device tends to be negatively charged when rubbed with a charging member, and thus is easily collected by a developing device. In order to negatively charge a toner, a metal oxide or resin particles can be added to the surface layer.

The electrophotographic photosensitive member includes a support, an undercoat layer disposed on the support, and a photosensitive layer disposed on the undercoat layer. The photosensitive layer is classified into a single-layer type photosensitive layer containing both a charge generation material and a charge transport material and a multilayer type photosensitive layer in which a charge generating layer containing a charge generation material and a charge transporting layer containing a charge transport material are stacked. In particular, the multilayer type photosensitive layer is employed, and the surface layer is a charge transporting layer.

Figure 2A:
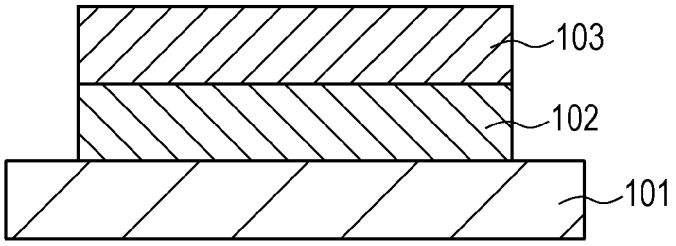
FIGS. 2A and 2B illustrate examples of layer structures of the electrophotographic photosensitive member.
Figure 2B:
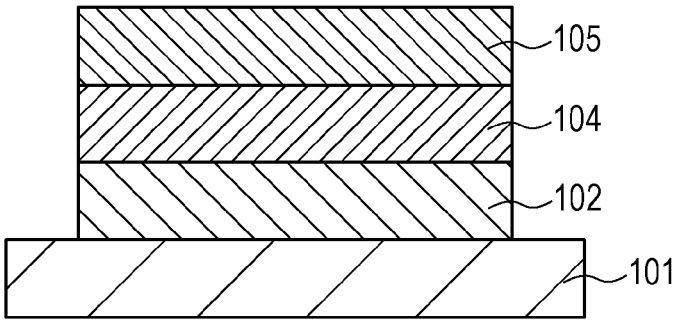

FIGS. 2A and 2B illustrate examples of layer structures of the electrophotographic photosensitive member according to an embodiment of the present invention. In FIG. 2A, an undercoat layer 102 is disposed on a support 101, a photosensitive layer 103 is disposed on the undercoat layer 102, and the photosensitive layer 103 serves as a surface layer. In FIG. 2B, an undercoat layer 102 is disposed on a support 101, a charge generating layer 104 is disposed on the undercoat layer 102, a charge transporting layer 105 is disposed on the charge generating layer 104, and the charge transporting layer 105 serves as a surface layer.

Support

The support is, for example, a conductive support such as a metal support formed of a metal or an alloy, e.g., aluminum, an aluminum alloy, and stainless steel. When aluminum or an aluminum alloy is used, an aluminum tube produced by a method including extrusion and drawing or an aluminum tube produced by a method including extrusion and ironing can be used.

A conductive layer may be disposed between the support and an undercoat layer in order to cover defects of the support and suppress the interference fringes.

The conductive layer can be formed by dispersing conductive particles such as particles of carbon black, a metal, or a metal oxide in a binder resin. The conductive particles are, for example, metal oxide particles.

The metal oxide particles may be metal oxide particles whose surfaces are treated with a surface-treating agent such as a silane coupling agent in order to suppress black-spot-like image defects formed by performing charge injection from the support toward the photosensitive layer.

Examples of the silane coupling agent include N-2-(aminoethyl)-3-aminopropylmethyldimethoxysilane, 3-aminopropylmethyldiethoxysilane, (phenylaminomethyl) methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, vinyltrimethoxysilane, 3-aminopropyltriethoxysilane, N-(2-aminoethyl)-3-aminopropyltrimethoxysilane, methyltrimethoxysilane, 3-glycidoxypropyltrimethoxysilane, 3-methacryloxypropyltrimethoxysilane, 3-chloropropyltrimethoxysilane, and 3-mercaptopropyltrimethoxysilane.

Examples of the binder resin used in the conductive layer include acrylic resin, allyl resin, alkyd resin, ethyl cellulose resin, ethylene-acrylic acid copolymers, epoxy resin, casein resin, silicone resin, gelatin resin, phenolic resin, urethane resin, butyral resin, melamine resin, polyacrylate, polyacetal, polyamide-imide, polyamide, polyallyl ethers, polyimide, polyester, polyethylene polycarbonate, polystyrene, polysulfone, polyvinyl alcohol, polybutadiene, and polypropylene. Among them, a urethane resin having low moisture absorbency is particularly used in terms of suppressing the environment-dependence of potential variation. The urethane resin is formed of a cured product of an isocyanate compound and a polyol resin. Examples of the isocyanate compound include 2,4-tolylene diisocyanate, 2,6-tolylene diisocyanate, diphenylmethane-4,4'-diisocyanate, 1-isocyanato-3,3,5-trimethyl-5-isocyanatomethylcyclohexane (isophorone diisocyanate, IPDI), hexamethylene diisocyanate (HDI), HDI-trimethylolpropane adducts, HDI-isocyanurate, and HDI-biuret. Among these isocyanate compounds, aliphatic diisocyanates such as hexamethylenediisocyanate and isophorone diisocyanate are particularly used because the crosslinking density can be easily increased.

In view of solution stability, these isocyanates are, for example, blocked isocyanates which are blocked with a blocking agent. Examples of the blocking agent include oxime compounds such as formaldehyde oxime, acetaldoxime, methyl ethyl ketoxime, cyclohexanone oxime, acetone oxime, and methyl isobutyl ketoxime; active methylene compounds such as Meldrum's acid, dimethyl malonate, diethyl malonate, di-n-butyl malonate, ethyl acetate, and acetylacetone; amine compounds such as diisopropylamine, diphenylaniline, aniline, and carbazole; imine compounds such as ethyleneimine and polyethyleneimine; acid imide compounds such as succinimide and maleimide; imidazole compounds such as malonate, imidazole, benzimidazole, and 2-methylimidazole; triazole compounds such as 1,2,3-triazole, 1,2,4-triazole, 4-amino-1,2,4-triazole, and benzotriazole; acid amide compounds such as acetanilide, N-methylacetamide, and acetic acid amide; lactam compounds such as ϵ-caprolactam, δ-valerolactam, and γ-butyrolactam; urea compounds such as urea, thiourea, and ethyleneurea; sulfites such as sodium bisulfite; mercaptan compounds such as butylmercaptan and dodecylmercaptan; phenolic compounds such as phenol and cresol; pyrazole compounds such as pyrazole, 3,5-dimethylpyrazole, and 3-methylpyrazole; and alcohol compounds such as methanol, ethanol, 2-propanol, and n-butanol. These blocking agents may be used alone or in combination of two or more.

Examples of the polyol resin include polyvinyl acetal, polyphenol, polyethylene diol, polycarbonate diol, polyether polyol, and polyacrylic polyol. In an embodiment of the present invention, polyvinyl acetal is particularly used.

The conductive layer may contain a metal salt of an organic acid, such as a bismuth, zinc, cobalt, or iron salt of an organic acid. Specific examples of the metal salt of an organic acid include bismuth octoate, zinc octoate, cobalt octoate, iron octoate, bismuth naphthenate, zinc naphthenate, cobalt naphthenate, iron naphthenate, and iron salicylate. Among them, bismuth octoate, zinc octoate, cobalt octoate, and iron octoate are particularly used. The mass ratio of the metal salt of an organic acid contained is, for example, metal salt of organic acid:metal oxide particles=1:200 to 2:10.

In the conductive layer, the mass ratio of the metal oxide particles and the resin is, for example, 1:1 to 4:1 (metal oxide particles/resin). When the mass ratio is in the range of 1:1 to 4:1, a change in the light-area potential in the repeated use is sufficiently suppressed. Furthermore, formation of cracks in the conductive layer is sufficiently suppressed.

A solvent for a conductive layer-forming coating liquid is, for example, an ether solvent, an alcohol solvent, a ketone solvent, or an aromatic hydrocarbon solvent. The thickness of the conductive layer is preferably 5 μm or more and 40 μm or less and more preferably 10 μm or more and 30 μm or less.

An undercoat layer is disposed between the support or the conductive layer and a photosensitive layer (charge generating layer or charge transporting layer).

The undercoat layer can be formed by applying an undercoat layer-forming coating liquid containing a resin (binder resin) onto the support or the conductive layer to form a coating film and then drying the coating film.

Examples of the resin (binder resin) used for the undercoat layer include polyvinyl alcohol, polyvinyl methyl ether, polyacrylic acids, methyl cellulose, ethyl cellulose, polyglutamic acid, polyamide, polyimide, polyamide-imide, polyamic acid, melamine resin, epoxy resin, polyurethane, and polyglutamic acid ester. The thickness of the undercoat layer is, for example, 0.1 μm or more and 5 μm or less.

To improve the flow of charges from the photosensitive layer to the support, the undercoat layer may contain an electron transport material and conductive particles. In particular, a polymer of a composition containing an electron transport material having a reactive functional group (polymerizable functional group) is desirably contained in terms of electron injection. Thus, when the photosensitive layer is formed on the undercoat layer, elution of a material for the undercoat layer to a solvent of a photosensitive layer-forming coating liquid can be suppressed.

In the cleanerless system, for example, a residual toner is negatively charged using a pre-exposure device or a charging device because a toner having different polarities is left as the residual toner after the transfer step. However, this tends to electrically degrade the electrophotographic photosensitive member, which easily increases the light-area potential. The addition of an electron transport material to the undercoat layer effectively suppresses an increase in the light-area potential.

Examples of the electron transport material include quinone compounds, imide compounds, benzimidazole compounds, and cyclopentadienylidene compounds.

Examples of the reactive functional group include a hydroxy group, a thiol group, an amino group, and a carboxy group.

In the undercoat layer, the content of the electron transport material having a reactive functional group in the composition is, for example, 30 mass % or more and 70 mass % or less.

Specific examples of the electron transport material having a reactive functional group are shown below.

(A1)

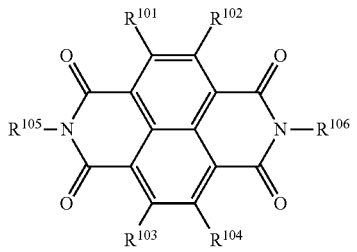

-continued (A2)

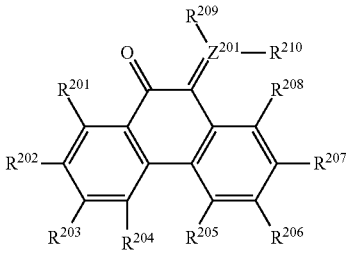

(A3)

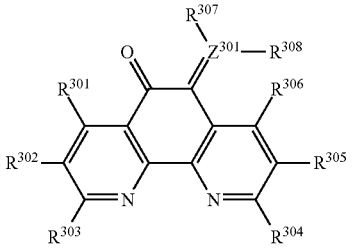

(A4)

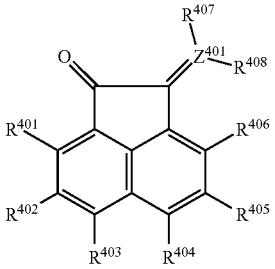

(A5)

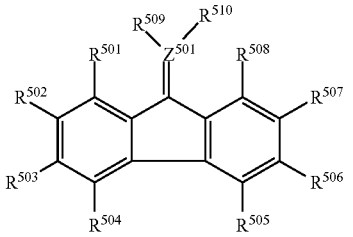

(A6)

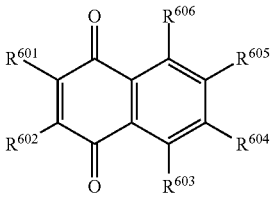

(A7)

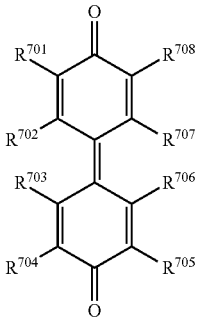

-continued (A8)

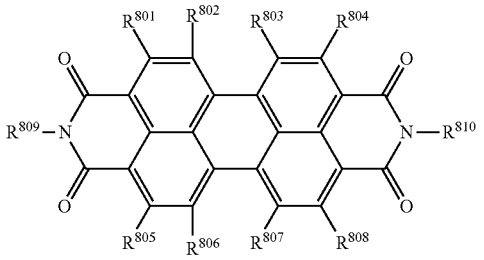

(A9)

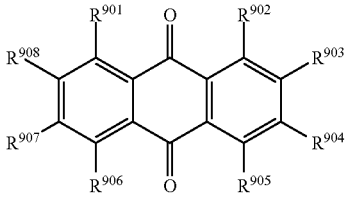

In formulae (A1) to (A9), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, and $R^{901}$ to $R^{908}$ each independently represent a monovalent group represented by formula (1) or (2) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. The substituent of the substituted alkyl group is an alkyl group, an aryl group, a halogen atom, or a carbonyl group. The substituent of the substituted aryl group or the substituted heterocyclic group is a halogen atom, a nitro group, a cyano group, an alkyl group, a halogen-substituted alkyl group, an alkoxy group, or a carbonyl group. $Z^{201}$, $Z^{301}$, $Z^{401}$, and $Z^{501}$ each independently represent a carbon atom, a nitrogen atom, or an oxygen atom. When $Z^{201}$ represents an oxygen atom, $R^{209}$ and $R^{210}$ are not present. When $Z^{201}$ represents a nitrogen atom, $R^{210}$ is not present. When $Z^{301}$ represents an oxygen atom, $R^{307}$ and $R^{308}$ are not present. When $Z^{301}$ represents a nitrogen atom, $R^{308}$ is not present. When $Z^{401}$ represents an oxygen atom, $R^{407}$ and $R^{408}$ are not present. When $Z^{401}$ represents a nitrogen atom, $R^{408}$ is not present. When $Z^{501}$ represents an oxygen atom, $R^{509}$ and $R^{510}$ are not present. When $Z^{501}$ represents a nitrogen atom, $R^{510}$ is not present.

At least one of $R^{101}$ to $R^{160}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$, and at least one of $R^{901}$ to $R^{908}$ represent the group represented by the formula (1) or (2) below.

$$-\!\!\!-A \qquad (1)$$

$$-\!\!\!-(B)_l-C-D \qquad (2)$$

In the formulae (1) and (2), at least one of A, B, C, and D represents a group having a reactive functional group; the reactive functional group is a hydroxy group, a thiol group, an amino group, or a carboxy group; and 1 represents 0 or 1.

In the formula (1), A represents a carboxy group, a substituted or unsubstituted alkyl group having a main chain with 1 to 6 atoms, a group having a main chain with 1 to 6 atoms, the group being obtained by substituting one of carbon atoms in the main chain of the substituted or unsubstituted alkyl group with an oxygen atom, or a group having a main chain with 1 to 6 atoms, the group being obtained by substituting one of carbon atoms in the main chain of the substituted or unsubstituted alkyl group with $NR^1$, where $R^1$ represents a hydrogen atom or an alkyl group. The substituent of the substituted alkyl group is at least one selected from the group consisting of an alkyl group having 1 to 6 carbon atoms, a benzyl group, a phenyl group, a hydroxy group, a thiol group, an amino group, and a carboxy group.

In the formula (2), B represents a substituted or unsubstituted alkylene group having a main chain with 1 to 6 atoms, a group having a main chain with 1 to 6 atoms, the group being obtained by substituting one of carbon atoms in the main chain of the substituted or unsubstituted alkylene group with an oxygen atom, or a group having a main chain with 1 to 6 atoms, the group being obtained by substituting one of carbon atoms in the main chain of the substituted or unsubstituted alkylene group with $NR^2$, where $R^2$ represents a hydrogen atom or an alkyl group. The substituent of the substituted alkylene group is at least one selected from the group consisting of an alkyl group having 1 to 6 carbon atoms, a benzyl group, an alkoxycarbonyl group, a phenyl group, a hydroxy group, a thiol group, an amino group, and a carboxy group.

In the formula (2), C represents a phenylene group, a phenylene group substituted with an alkyl group having 1 to 6 carbon atoms, a nitro group-substituted phenylene group, a halogen group-substituted phenylene group, or an alkoxy group-substituted phenylene group. These groups may have, as a reactive functional group, at least one substituent selected from the group consisting of a hydroxy group, a thiol group, an amino group, and a carboxy group.

In the formula (2), D represents a hydrogen atom or a substituted or unsubstituted alkyl group having a main chain with 1 to 6 atoms. The substituent of the substituted alkyl group is at least one selected from the group consisting of an alkyl group having 1 to 6 carbon atoms, a hydroxy group, a thiol group, an amino group, and a carboxy group.

Specific examples of the electron transport material having a reactive functional group are shown below. Table 1 shows specific examples of the compound represented by the above formula (A1).

TABLE 1

| Example compound | $R^{101}$ | $R^{102}$ | $R^{103}$ | $R^{104}$ | $R^{105}$ | $R^{106}$ | (1) A |
|---|---|---|---|---|---|---|---|
| A101 | H | H | H | H | 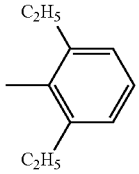 | (1) | 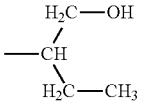 |
| A102 | H | H | H | H | 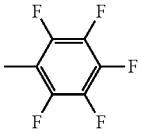 | (1) | —COOH |
| A103 | CN | H | H | CN | 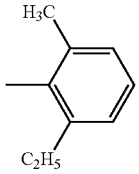 | (2) | — |
| A104 | H | $NO_2$ | H | $NO_2$ | 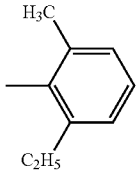 | (1) | 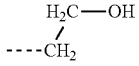 |
| A105 | F | H | H | F | (2) | (2) | — |
| A106 | H | H | H | H | 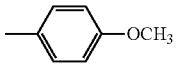 | (2) | — |
| A107 | H | H | H | H | 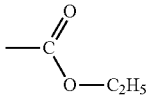 | (2) | — |
| A108 | H | H | H | H | 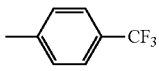 | (2) | — |

TABLE 1-continued
| | | | | | | | |
|---|---|---|---|---|---|---|---|
| A109 | H | H | H | H | 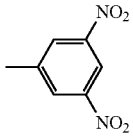 | (2) | — |
| A110 | H | H | H | H | 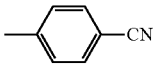 | (2) | — |
| A111 | H | H | H | H | 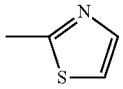 | (1) | 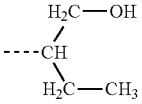 |
| A112 | H | H | H | H | 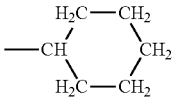 | (1) | 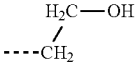 |
| A113 | H | H | H | H | 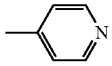 | (2) | — |
| A114 | H | H | H | H | 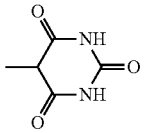 | (2) | — |
| A115 | H | H | H | H | $—C_2H_4—O—C_2H_5$ | (2) | — |
| A116 | H | H | H | H | 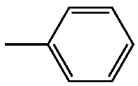 | (1) | $—(CH_2)_6—OH$ |
| A117 | H | H | H | H | (2) | (2) | — |
| A118 | H | H | H | H | (2) | (1)' | — |
| A119 | H | H | H | H | (1) | (1) | 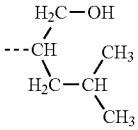 |
| A120 | H | H | H | H | (1) | (1)' | 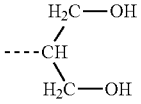 |
| Example | (2) | | | (1)' | (2)' | | |
|---|---|---|---|---|---|---|---|
| compound | B | C | D | A | B | C | D |
| A101 | — | — | — | — | — | — | — |
| A102 | — | — | — | — | — | — | — |
| A103 | — | 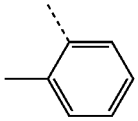 | 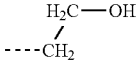 | — | — | — | — |
| A104 | — | — | — | — | — | — | — |
| A105 | — | 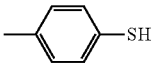 | — | — | — | — | — |
| A106 | — | 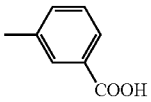 | — | — | — | — | — |

TABLE 1-continued

| | | | | | | | |
|---|---|---|---|---|---|---|---|
| A107 | — | 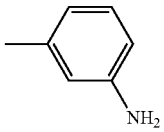 | — | — | — | — | — |
| A108 | — | 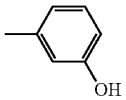 | — | — | — | — | — |
| A109 | — | 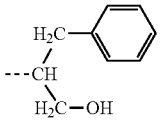 | — | — | — | — | — |
| A110 | — | 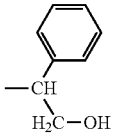 | — | — | — | — | — |
| A111 | — | — | — | — | — | — | — |
| A112 | — | — | — | — | — | — | — |
| A113 | —$CH_2CH_2$— | 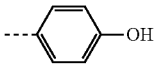 | — | — | — | — | — |
| A114 | — | 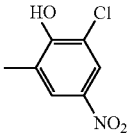 | — | — | — | — | — |
| A115 | — | 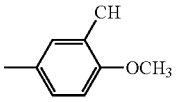 | — | — | — | — | — |
| A116 | — | — | — | — | — | — | — |
| A117 | — | 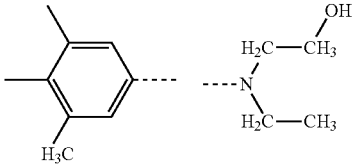 | | — | — | — | — |
| A118 | — | 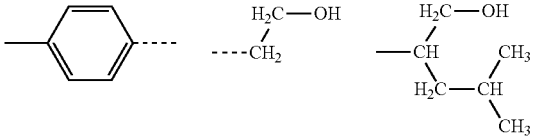 | | | — | — | — |
| A119 | — | — | — | — | — | — | — |
| A120 | — | — | — | 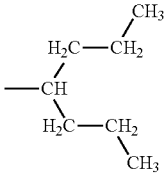 | — | — | — |

The derivative having the structure represented by the formula (A1) can be synthesized by causing a reaction of a monoamine derivative and naphthalenetetracarboxylic dianhydride available from Tokyo Chemical Industry Co., Ltd. or Sigma-Aldrich Japan. The derivative (derivative of electron transport material) having the structure represented by any of the formulae (A2) to (A6) and (A9) is available from Tokyo Chemical Industry Co., Ltd., Sigma-Aldrich Japan, or Johnson Matthey Japan G. K. The derivative having the structure represented by the formula (A7) can be synthesized using, as a raw material, a phenolic derivative available from Tokyo Chemical Industry Co., Ltd. or Sigma-Aldrich Japan. The derivative having the structure represented by the formula (A8) can be synthesized by a reaction of a monoamine derivative and perylenetetracarboxylic dianhydride available from Tokyo Chemical Industry Co., Ltd. or Johnson Matthey Japan G. K.

The compound represented by any of the formulae (A1) to (A9) has a reactive functional group (hydroxy group, thiol group, amino group, carboxy group, or methoxy group) which is polymerizable with a crosslinking agent. The following two methods are employed to introduce such a polymerizable functional group into the derivative having the structure represented by any of the formulae (A1) to (A9): a first method for directly introducing a reactive functional group into the derivative having the structure represented by any of the formulae (A1) to (A9) and a second method for introducing a structure having a reactive functional group or a functional group to be a precursor of the reactive functional group into the derivative having the structure represented by any of the formulae (A1) to (A9). The second method is, for example, a method for introducing a functional group-containing aryl group by performing a cross-coupling reaction that uses a palladium catalyst and a base on a halide of the derivative having the structure represented by any of the formulae (A1) to (A9). Alternatively, the second method is, for example, a method for introducing a functional group-containing alkyl group by performing a cross-coupling reaction that uses an $FeCl_3$ catalyst and a base on a halide of the derivative having the structure represented by any of the formulae (A1) to (A9). In addition, the second method is, for example, a method for introducing a hydroxyalkyl group or a carboxy group by performing lithiation on a halide of the derivative having the structure represented by any of the formulae (A1) to (A9) and then acting an epoxy compound or $CO_2$ thereon.

Crosslinking Agent

Next, a Crosslinking Agent Will be Described.

The crosslinking agent is, for example, a compound which is polymerized or crosslinked with a reactive functional group-containing electron transport material and a reactive functional group-containing thermoplastic resin described below. Specifically, compounds listed in, for example, "Kakyozai Handbook [Handbook of crosslinking agents]" edited by Shinzo Yamashita and Tousuke Kaneko and published by Taiseisha Ltd. (1981) can be used.

An example of the crosslinking agent is an isocyanate compound. The isocyanate compound is, for example, an isocyanate compound having a molecular weight of 200 to 1300. The isocyanate compound is also, for example, an isocyanate compound having two or more isocyanate groups or blocked isocyanate groups and particularly an isocyanate compound having 3 to 6 isocyanate groups or blocked isocyanate groups. Examples of the isocyanate compound include triisocyanate benzene, triisocyanate methylbenzene, triphenylmethane triisocyanate, and lysine triisocyanate; isocyanurate-modified products, biuret-modified products, and allophanate-modified products of diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanatehexanoate, and norbornane diisocyanate; and adduct-modified products of trimethylolpropane and pentaerythritol. Among them, isocyanurate-modified products and adduct-modified products are particularly used.

The blocked isocyanate group is a group having a structure of —$NHCOX^1$ ($X^1$: protective group), where $X^1$ may be any protective group as long as $X^1$ can be introduced into an isocyanate group, and is, for example, a group represented by any of formulae (H1) to (H7) below.

(1)

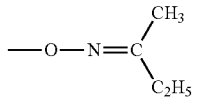

(2)

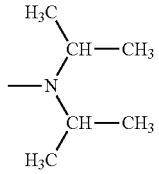

(3)

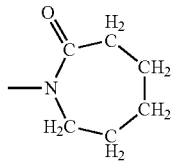

(4)

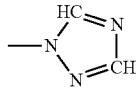

(5)

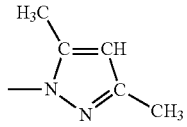

(6)

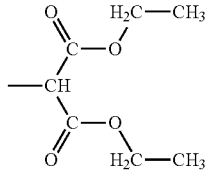

(7)

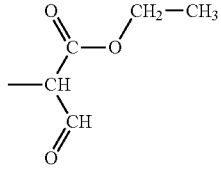

Specific examples of the isocyanate compound are shown below.

(B1)

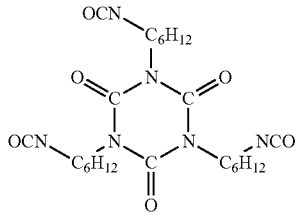

-continued (B2)

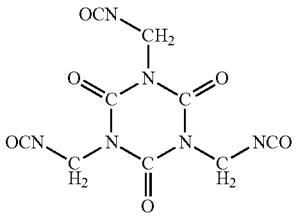

(B3)

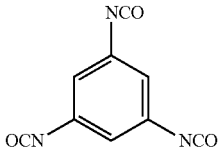

(B4)

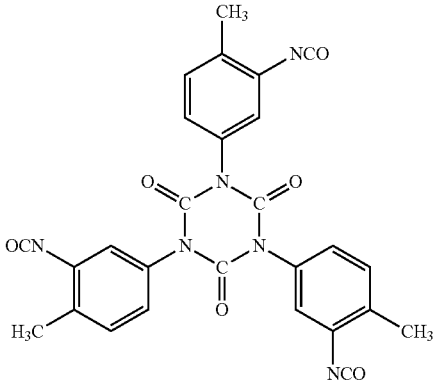

(B5)

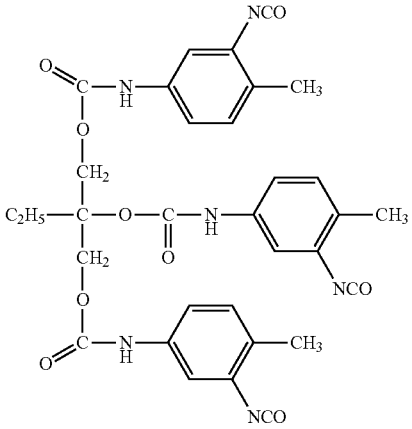

(B6)

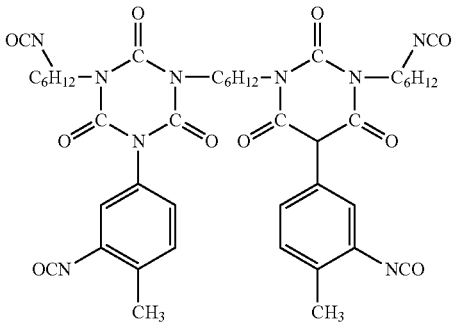

-continued (B7)

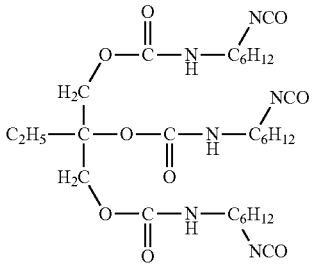

(B8)

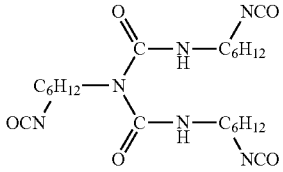

(B9)

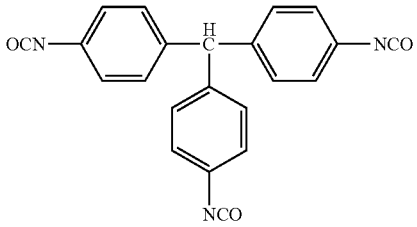

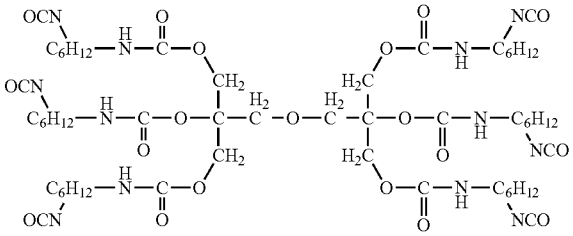

The composition containing the electron transport material having a reactive functional group and the crosslinking agent may further contain a thermoplastic resin having a reactive functional group. The thermoplastic resin having a reactive functional group is, for example, a thermoplastic resin having a structural unit represented by formula (D) below.

(D)

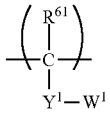

In the formula (D), $R^{61}$ represents a hydrogen atom or an alkyl group; $Y^1$ represents a single bond, an alkylene group, or a phenylene group; and $W^1$ represents a hydroxy group, a thiol group, an amino group, a carboxy group, or a methoxy group.

For example, the thermoplastic resin having the structural unit represented by the formula (D) further has a moiety of butyral, olefin, ester, ether, cellulose, polyamide, or the like. Examples of the thermoplastic resin having the structural unit represented by the formula (D) include polyvinyl butyral, acetal resin, polyolefin resin, polyester resin, polyether resin, and polyamide resin.

The resin D is also commercially available. Examples of the commercially available resin include polyether polyol resins such as AQD-457 and AQD-473 manufactured by Nippon Polyurethane Industry Co., Ltd. and SANNIX GP-400 and GP-700 manufactured by Sanyo Chemical Industries, Ltd.; polyester polyol resins such as Phthalkyd W2343 manufactured by Hitachi Chemical Co., Ltd., Watersol S-118 and CD-520 and Beckolite M-6402-50 and M-6201-40IM, all of which are manufactured by DIC Corporation, Haridip WH-1188 manufactured by Harima Chemicals Inc., and ES3604 and ES6538 manufactured by Japan U-Pica Co., Ltd.; polyacrylic polyol resins such as Burnock WE-300 and WE-304 manufactured by DIC Corporation; polyvinyl alcohol resins such as Kuraray Poval PVA-203 manufactured by Kuraray Co., Ltd.; polyvinyl acetal resins such as BX-1 and BM-1 manufactured by Sekisui Chemical Co., Ltd.; polyamide resins such as Toresin FS-350 manufactured by Nagase ChemteX Corporation; carboxy group-containing resins such as Aqualic manufactured by Nippon Shokubai Co., Ltd. and Finelex SG2000 manufactured by Namariichi Co., Ltd.; polyamine resins such as Luckamide manufactured by DIC Corporation; and polythiol resins such as QE-340M manufactured by Toray Industries Inc. Among them, polyvinyl acetal resins and polyester polyol resins are particularly used. The weight-average molecular weight (Mw) of the resin D is, for example, in the range of 5000 to 300000.

Photosensitive Layer

A photosensitive layer is disposed on the support, the conductive layer, or the undercoat layer. The photosensitive layer is, for example, a multilayer type photosensitive layer including a charge generating layer and a charge transporting layer. The charge generating layer contains a charge generation material and a binder resin.

Examples of the charge generation material include azo pigments, phthalocyanine pigments, indigo pigments such as indigo and thioindigo, perylene pigments, polycyclic quinone pigments, squarylium dyes, pyrylium salts, thiapyrylium salts, triphenylmethane dyes, quinacridone pigments, azulenium salt pigments, cyanine dyes, xanthene dyes, quinoneimine dyes, and styryl dyes. Among them, metal phthalocyanines such as oxytitanium phthalocyanine, hydroxygallium phthalocyanine, and chlorogallium phthalocyanine are particularly used.

When the photosensitive layer is a multilayer type photosensitive layer, the charge generating layer can be formed by applying a charge generating layer-forming coating liquid prepared by dispersing the charge generation material and the binder resin in a solvent and then drying the applied coating liquid. The dispersion is performed by a method that uses, for example, a homogenizer, an ultrasonic disperser, a ball mill, a sand mill, an attritor, or a roll mill.

Examples of the binder resin used for the charge generating layer include polycarbonate, polyester, polyarylate, butyral resin, polystyrene, polyvinyl acetal, diallyl phthalate resin, acrylic resin, methacrylic resin, vinyl acetate resin, phenolic resin, silicone resin, polysulfone, styrene-butadiene copolymers, alkyd resin, epoxy resin, urea resin, and vinyl chloride-vinyl acetate copolymers. These binder resins can be used alone or in combination of two or more as a mixture or a copolymer.

The mass ratio of the charge generation material and the binder resin (charge generation material:binder resin) is preferably 10:1 to 1:10, more preferably 5:1 to 1:1, and further preferably 3:1 to 1:1.

Examples of the solvent used for the charge generating layer-forming coating liquid include alcohols, sulfoxides, ketones, ethers, esters, halogenated aliphatic hydrocarbons, and aromatic compounds.

The thickness of the charge generating layer is preferably 0.1 μm or more and 5 μm or less and more preferably 0.1 μm or more and 2 μm or less.

The charge generating layer may optionally contain a sensitizer, an antioxidant, an ultraviolet absorber, a plasticizer, and the like. In order to achieve smooth flow of charges in the charge generating layer, the charge generating layer may contain an electron transport material (electron accepting material such as an acceptor).

When the photosensitive layer is a multilayer type photosensitive layer, the charge transporting layer can be formed by forming a coating film of a charge transporting layer-forming coating liquid prepared by dissolving a charge transport material and a binder resin in a solvent and then drying the coating film. When the charge transporting layer is a surface layer, the above-described polycarbonate resin or the polyarylate resin is used as the binder resin.

Specific examples of the charge transport material include hydrazone compounds, styryl compounds, benzidine compounds, triarylamine compounds, and triphenylamine compounds.

Examples of the binder resin include acrylic resin, styrene resin, polyester resin, polycarbonate, polyarylate, polysulfone, polyphenylene oxide, epoxy resin, polyurethane, and alkyd resin. In particular, polyester, polycarbonate, and polyarylate can be used. These binder resins can be used alone or in combination of two or more as a mixture or a copolymer.

The mass ratio of the charge transport material and the binder resin (charge transport material:binder resin) is, for example, in the range of 2:1 to 1:2.

Examples of the solvent used for the charge transporting layer-forming coating liquid include ketones such as acetone and methyl ethyl ketone; esters such as methyl acetate and ethyl acetate; ethers such as dimethoxymethane and dimethoxyethane; aromatic hydrocarbons such as toluene and xylene; and hydrocarbons substituted with halogen atoms, such as chlorobenzene, chloroform, and carbon tetrachloride.

The thickness of the charge transporting layer is preferably 3 μm or more and 40 μm or less and more preferably 5 μm or more and 30 μm or less.

The charge transporting layer may optionally contain an antioxidant, an ultraviolet absorber, a plasticizer, and the like.

A protective layer (surface layer) may also be disposed on the photosensitive layer in order to protect the photosensitive layer. The protective layer can be formed by forming a coating film of a protective layer-forming coating liquid containing a resin (binder resin) and then drying and/or curing the coating film.

The above-described polycarbonate resin or polyarylate resin is used as the binder resin for the protective layer.

The thickness of the protective layer is preferably 0.5 μm or more and 10 μm or less and more preferably 1 μm or more and 8 μm or less.

The coating liquid for forming each of the above-described layers can be applied by, for example, a dip coating method, a spray coating method, a spinner coating method, a roller coating method, a Meyer bar coating method, or a blade coating method.

A charging device according to an embodiment of the present invention will be described in detail.

Charging Device

The charging device is, for example, a charging roller that comes into contact with the electrophotographic photosensitive member. The charging roller may have a single-layer structure including a metal core and an elastic layer disposed on the outer periphery of the metal core or may have a two-layer structure including the metal core, the elastic layer, and a surface layer disposed on the elastic layer.

The ten-point average roughness (Rzjis) on the surface of the charging roller is, for example, 5.0 μm or less. The ten-point average roughness (Rzjis) on the surface of the charging roller is measured with a surface roughness tester (trade name: SE-3400) manufactured by Kosaka Laboratory Ltd.

The elastic layer is formed of a rubber component. The rubber component is not particularly limited, and a rubber publicly known in the field of charging members can be used. Specific examples of the rubber component include epichlorohydrin homopolymers, epichlorohydrin-ethylene oxide copolymers, epichlorohydrin-ethylene oxide-allyl glycidyl ether ternary copolymers, acrylonitrile-butadiene copolymers, hydrogenated products of acrylonitrile-butadiene copolymers, silicone rubber, acrylic rubber, and urethane rubber.

The surface layer can be formed of a resin publicly known in the field of charging members. Specific examples of the resin include acrylic resin, polyurethane, polyamide, polyester, polyolefin, and silicone resin. The surface layer may also contain carbon black, graphite, an oxide having conductivity, such as tin oxide, a metal such as copper or silver, conductive particles to which conductivity is imparted by coating particle surfaces with an oxide or a metal, and an ionic conductive agent having ion exchangeability, such as a quaternary ammonium salt.

The volume resistivity of the charging roller is roughly $1\times10^{6}$ Ω·cm or more and $1\times10^{14}$ Ω·cm or less and preferably $1\times10^{7}$ Ω·cm or more and $1\times10^{9}$ Ω cm or less.

When the volume resistivity of the charging roller is $1\times10^{7}$ Ω cm or more, the amount of downstream discharge considerably increases. The use of the downstream discharge for the residual toner after the charging roller has passed can negatively charge the residual toner, and thus the residual toner is more easily collected by the developing device. When the volume resistivity of the charging roller is $1\times10^{9}$ Ω·cm or less, adverse effects on images caused by lack of electrical resistance can be further suppressed.

In an embodiment of the present invention, for example, the electrophotographic photosensitive member and the charging roller are rotated so that the contact portions of the electrophotographic photosensitive member and the charging roller move in the same direction. In this case, the residual toner tends to pass through a nip portion between the electrophotographic photosensitive member and the charging roller, the residual toner is prevented from being left on the surface of the electrophotographic photosensitive member. This suppresses charging failure caused by deposition of the residual toner.

In an embodiment of the present invention, for example, a peripheral speed difference is generated between the electrophotographic photosensitive member and the charging roller. In this case, the residual toner tends to pass through a nip portion between the electrophotographic photosensitive member and the charging roller. In addition, when the residual toner passes through the nip portion, the residual toner is easily negatively charged by being rubbed with the charging roller. Such a negatively charged residual toner is more easily collected by the developing device (developing roller). Furthermore, for example, the peripheral speed of the charging roller is higher than that of the electrophotographic photosensitive member. As a result, the surface of the charging roller that faces the electrophotographic photosensitive member is refreshed, which achieves more uniform discharge.

For the hardness of the charging roller, the universal hardness of the surface at the time when an indenter is inserted by 1 μm is, for example, 1.0 N/mm$^2$ or more and 10.0 N/mm$^2$ or less. A universal hardness of 1.0 N/mm$^2$ or more can suppress adverse effects on images derived from deformation of the charging roller caused when the charging roller and the electrophotographic photosensitive member are in contact with each other while standing still for a long time. A universal hardness of 10.0 N/mm$^2$ or less can sufficiently provide a nip between the charging roller and the electrophotographic photosensitive member.

The universal hardness of the surface of the charging roller is measured with, for example, a universal hardness meter (trade name: Ultra-micro Hardness meter H-100V manufactured by Fisher Instruments). The universal hardness is a physical property determined by inserting an indenter into a measurement object while applying a load, and is determined as (test load)/(surface area of indenter under test load) (N/mm$^2$). That is, for example, a quadrangular pyramid indenter is inserted into a measurement object to the predetermined indentation depth while applying a predetermined relatively small test load. The surface area of the indenter that is in contact with the object is determined from the indentation depth. The universal hardness is determined from the above formula.

EXAMPLES

Hereafter, the present invention will be further described in detail based on specific Examples, but is not limited thereto. Hereafter, "part" refers to "part by mass".

Production Example of Toner

Production Example of Magnetic Material 1

To an aqueous solution of ferrous sulfate, 1.0 to 1.1 equivalents of a caustic soda solution on an elemental iron basis, 0.15 mass % of $P_2O_5$ in terms of elemental phosphorus on an elemental iron basis, and 0.5 mass % of $SiO_2$ in terms of elemental silicon on an elemental iron basis were added, thereby preparing an aqueous solution containing ferrous hydroxide. The pH of the aqueous solution containing ferrous hydroxide was adjusted to 8.0. An oxidation reaction was performed at 85° C. while blowing air. Thus, a slurry containing seed crystals was prepared.

Next, 0.9 to 1.2 equivalents of an aqueous solution of ferrous sulfate based on the amount of alkali (sodium component of caustic soda) was added to the slurry. The slurry was maintained at pH 7.6. An oxidation reaction was allowed to proceed while blowing air to prepare a slurry containing magnetic iron oxide. After filtration and washing, the water-containing slurry was temporarily removed. At this time, a small amount of the water-containing sample was collected, and the water content thereof was measured. The water-containing sample was then poured into another aqueous medium without being dried. The resulting slurry was stirred. The slurry was re-dispersed with a pin mill while being circulated. The pH of the re-dispersion liquid was adjusted to about 4.8. Subsequently, 1.6 parts of a n-hexyltrimethoxysilane coupling agent was added to 100 parts of magnetic iron oxide under stirring (the amount of magnetic iron oxide was calculated as a value obtained by subtracting the water content from the water-containing sample) to perform hydrolysis. Stirring was then performed. The pH of the dispersion liquid was adjusted to 8.6, and a surface treatment was performed. The resulting hydrophobic magnetic material was filtered with a filter press and washed with a large amount of water. The hydrophobic magnetic material was dried at 100° C. for 15 minutes and then at 90° C. for 30 minutes. The resulting particles were subjected to a disaggregation treatment to provide a magnetic material 1 having a volume-average particle diameter of 0.21 μm.

Production Example of Polyester Resin B1

Monomers listed in Table 2 were inserted into a reaction vessel equipped with a nitrogen inlet, a dehydration tube, a stirrer, and a thermocouple at the ratio listed in Table 2. Then, 1.5 parts of dibutyltin serving as a catalyst was added to 100 parts of the entire monomers. Subsequently, the temperature was rapidly increased to 180° C. at normal pressure in a nitrogen atmosphere. Then, water was distilled off while the temperature was increased from 180° C. to 210° C. at a heating rate of 10° C./hour, thereby performing polycondensation. After the temperature reached 210° C., the pressure in the reaction vessel was decreased to 5 kPa or lower. Polycondensation was performed at 210° C. at 5 kPa or lower to obtain a polyester resin B1. Herein, the polymerization time was controlled so that the softening point of the obtained polyester resin B1 was a value (125° C.) listed in Table 3. Table 3 shows the physical properties of the polyester resin B1.

TABLE 2

| | Acid (mol) | | | Alcohol (mol) | |
|---|---|---|---|---|---|
| Monomer | TPA | IPA | TMA | BPA-PO | BPA-EO |
| Polyester resin B1 | 41 | 0 | 1 | 58 | 0 |

In Table 2, "TPA" refers to terephthalic acid, "IPA" refers to isophthalic acid, and "TMA" refers to trimellitic acid. Furthermore, "BPA-PO" refers to a bisphenol A-PO (2 mol) adduct and "BPA-EO" refers to a bisphenol A-EO (2 mol) adduct.

TABLE 3

| | Tg ° C. | Softening point ° C. | Acid value mgKOH/g |
|---|---|---|---|
| Polyester resin B1 | 75 | 125 | 0.5 |

Production Example of Toner 1

Toner particles and a toner were produced through the following procedure.

Preparation of First Water-Based Medium

To 342.8 parts of ion-exchanged water, 3.1 parts of sodium phosphate dodecahydrate was added. The temperature was increased to 60° C. while stirring was performed with a TK Homomixer (manufactured by Tokushu Kika Kogyo Co., Ltd.). Subsequently, an aqueous calcium chloride solution prepared by adding 1.8 parts of calcium chloride dihydrate to 12.7 parts of ion-exchanged water and an aqueous sodium chloride solution prepared by adding 4.3 parts of sodium chloride to 14.5 parts of ion-exchanged water were added thereto, and stirring was performed. Thus, a first water-based medium containing a dispersion stabilizer A was prepared.

Preparation of Polymerizable Monomer Composition

| | |
|---|---|
| Styrene | 74.0 parts |
| n-Butyl acrylate | 26.0 parts |
| 1,6-Hexanediol diacrylate | 0.5 parts |
| Aluminum salicylate compound (E-101: manufactured by ORIENT CHEMICAL INDUSTRIES Co., Ltd.) | 0.5 parts |
| Coloring agent: magnetic material 1 | 65.0 parts |
| Polyester resin B1 | 20.0 parts |

The above-mentioned materials were uniformly mixed with each other by performing dispersion using an attritor (manufactured by Mitsui Miike Machinery Co., Ltd.). Subsequently, the temperature was increased to 60° C., and 15 parts of paraffin wax (DSC peak temperature: 80° C.) was added thereto and dissolved. Thus, a polymerizable monomer composition was obtained.

Preparation of Second Water-Based Medium

To 164.7 parts of ion-exchanged water, 0.9 parts of sodium phosphate dodecahydrate was added. The temperature was increased to 60° C. while stirring was performed with a paddle stirring blade. Subsequently, an aqueous calcium chloride solution prepared by adding 0.5 parts of calcium chloride dihydrate to 3.8 parts of ion-exchanged water was added thereto, and stirring was performed. Thus, a second water-based medium containing a dispersion stabilizer B was prepared.

Granulation

The polymerizable monomer composition and 7 parts of t-butyl peroxypivalate serving as a polymerization initiator were added to the first water-based medium. The mixture was stirred at 60° C. in a nitrogen atmosphere using a TK Homomixer at 12000 rpm for 10 minutes to perform granulation. Thus, a granulation liquid containing droplets of the polymerizable monomer composition was obtained.

Polymerization/Distillation/Drying/External Addition

The granulation liquid was added to the second water-based medium, and a reaction was caused to proceed at 74° C. for 3 hours under stirring with a paddle stirring blade. After the completion of the reaction, distillation was performed at 98° C. for 3 hours. The resulting suspension was cooled, and hydrochloric acid was added and washing was performed. Then, filtration and drying were performed to obtain toner particles.

The materials below were mixed with 100 parts of the obtained toner particles using a Henschel mixer (FM-10 manufactured by Mitsui Miike Machinery Co., Ltd.) to obtain a toner 1. The liquid temperature in the Henschel mixer was adjusted to 45° C. using a jacket of the Henschel mixer. The obtained toner had an average circularity of 0.98, an average aspect ratio of 0.92, and a weight-average particle diameter of 8.1 μm.

Hydrophobic silica fine particles which were surface-treated with 25 mass % hexamethyldisilazane and whose primary particles had a number-average particle diameter of 20 nm 0.5 parts Hydrophobic silica fine particles which were surface-treated with 15 mass % hexamethyldisilazane and whose primary particles had a number-average particle diameter of 110 nm 0.5 parts Production Examples of Toners 2 to 5, 8, and 9

Desired toners were produced in the same manner as in Production Example of the toner 1, except that in the preparation of the first water-based medium, the amount of the sodium phosphate dodecahydrate added was changed from 3.1 parts and the amount of the calcium chloride dihydrate added was changed from 1.8 parts. When the amount of each of the materials added was increased, the weight-average particle diameter of the toner was smaller than that of the toner 1, which was 8.1 μm. When the amount was smaller than 0.5 parts, the weight-average particle diameter of the toner was larger than that of the toner 1, which was 8.1 μm. In Production Examples of the toners 2, 4, and 9, the amount of each of the materials added were increased compared with Production Example of the toner 1. In Production Examples of the toners 3, 5, and 8, the amount of each of the materials added was smaller than 0.5 parts.

Production Example of Toner 6

A toner 6 was produced in the same manner as in Production Example of the toner 1, except that in the preparation of the second water-based medium, the amount of the calcium chloride dihydrate added was changed from 0.5 parts to 0.25 parts.

Production Examples of Toners 7 and 10

A toner 7 was produced in the same manner as in Production Example of the toner 1, except that in the preparation of the second water-based medium, 0.5 parts of the calcium chloride dihydrate was no added and classification was performed after the filtration and the drying.

Production Example of Toner 11

A toner 11 was produced in the same manner as in Production Example of the toner 1, except that in the preparation of the second water-based medium, the amount of the calcium chloride dihydrate added was changed from 0.5 parts to 0.15 parts.

Production Example of Toner 12

A toner 12 was produced in the same manner as in Production Example of the toner 1, except that in the preparation of the second water-based medium, 0.5 parts of the calcium chloride dihydrate was not added.

Production Example of Toner 13

| | |
|---|---|
| Styrene-acrylic copolymer (mass ratio of styrene and n-butyl acrylate: 74.0:26.0, main peak molecular weight Mp: 10000) | 100 parts |
| Magnetic material 1 | 90 parts |
| Aluminum salicylate compound (E-101: manufactured by ORIENT CHEMICAL INDUSTRIES Co., Ltd.) | 0.5 parts |
| Paraffin wax (peak temperature of maximum endothermic peak: 80° C.) | 5 parts |

The above-mentioned materials were premixed using a Henschel mixer and then melt-kneaded using a biaxial extruder heated to 150° C. The kneaded mixture was cooled and roughly ground using a hammer mill to obtain a roughly ground toner product. The obtained roughly ground toner product was mechanically pulverized (finely pulverized) with a mechanical pulverizer Turbo Mill (manufactured by Turbo Industry Ltd., rotor and stator surfaces were plated with a chromium alloy containing chromium carbide (plating thickness: 150 μm, surface hardness HV: 1050)). The finely pulverized product was subjected to classification to remove a fine powder and a coarse powder at the same time with a multi-division classifier that utilizes a Coanda effect (ELBOW-JET classifier manufactured by Nittetsu Mining Co., Ltd.).

Subsequently, a thermal spheroidizing treatment was performed using a Surface Fusing System (manufactured by Nippon Pneumatic Mfg. Co., Ltd.). A spheroidizing apparatus was operated under the conditions: feeding rate=5 kg/hour, hot air temperature C=260° C., flow rate of hot air=6 $m^3$/min, cooling air temperature E=5° C., flow rate of cooling air=4 $m^3$/min, absolute moisture content of cooling air=3 g/$m^3$, air volume of blower=20 $m^3$/min, injection air flow rate=1 $m^3$/min, and diffused air=0.3 $m^3$/min.

By performing the thermal spheroidizing treatment, toner particles were obtained.

The materials below were mixed with 100 parts of the obtained toner particles using a Henschel mixer (FM-10 manufactured by Mitsui Miike Machinery Co., Ltd.) to obtain a toner 13. The temperature of the Henschel mixer was adjusted to 45° C. using a jacket of the Henschel mixer.

Hydrophobic silica fine particles which were surface-treated with 25 mass % hexamethyldisilazane and whose primary particles had a number-average particle diameter of 20 nm 0.5 parts Hydrophobic silica fine particles which were surface-treated with 15 mass % hexamethyldisilazane and whose primary particles had a number-average particle diameter of 110 nm 0.5 parts The obtained toner had an average circularity of 0.96, an average aspect ratio of 0.90, and a weight-average particle diameter (D4) of 8.0 μm.

Table 4 shows physical properties of the obtained toners 1 to 13.

TABLE 4

| | Size | Circularity | Aspect ratio |
|---|---|---|---|
| Toner 1 | 8.1 | 0.98 | 0.92 |
| Toner 2 | 8.0 | 0.98 | 0.92 |
| Toner 3 | 9.0 | 0.97 | 0.91 |
| Toner 4 | 7.1 | 0.98 | 0.93 |
| Toner 5 | 8.6 | 0.97 | 0.92 |
| Toner 6 | 8.2 | 0.97 | 0.91 |
| Toner 7 | 7.9 | 0.95 | 0.92 |
| Toner 8 | 10.2 | 0.98 | 0.92 |
| Toner 9 | 7.0 | 0.97 | 0.91 |
| Toner 10 | 8.1 | 0.94 | 0.90 |
| Toner 11 | 8.1 | 0.95 | 0.89 |
| Toner 12 | 8.1 | 0.90 | 0.88 |
| Toner 13 | 10.0 | 0.96 | 0.90 |

Production Example of Electrophotographic Photosensitive Member

Production Example of Electrophotographic Photosensitive Member 1

One hundred parts of zinc oxide particles (specific surface area: 19 $m^2$/g, powder resistivity: $1.0\times10^7$ Ω·cm) were mixed with 500 parts of toluene under stirring, and 1.5 parts of a silane coupling agent (surface treatment agent) was added thereto and stirring was performed for six hours. Subsequently, toluene was distilled off in a reduced pressure and drying was performed at 140° C. for six hours to obtain zinc oxide particles surface-treated with a silane coupling agent. The silane coupling agent was N-(2-aminoethyl)-3-aminopropylmethyldimethoxysilane (trade name: KBM602, manufactured by Shin-Etsu Chemical Co., Ltd.).

Next, 15 parts of a butyral resin (trade name: BM-1 manufactured by Sekisui Chemical Co., Ltd.) serving as a butyral resin and 15 parts of a blocked isocyanate resin (trade name: TPA-B80E, 80% solution, manufactured by Asahi Kasei Corporation) were dissolved in a mixed solvent of 73.5 parts of methyl ethyl ketone and 73.5 parts of cyclohexanone to prepare a solution.

To this solution, 81 parts of the zinc oxide particles surface-treated with the silane coupling agent and 0.8 parts of 2,3,4-trihydroxybenzophenone (manufactured by Tokyo Chemical Industry Co., Ltd.) were added. The mixture was inserted into a vertical sand mill that uses, as a dispersion medium, 180 parts of glass beads having an average particle diameter of 1.0 mm, and dispersed at 23±3° C. at a rotational speed of 1500 rpm (peripheral speed: 5.5 m/s) for four hours.

After the dispersion, 0.01 parts of silicone oil (trade name: SH28PA manufactured by Dow Corning Toray Silicone Co., Ltd.) and 5.6 parts of cross-linked polymethyl methacrylate (PMMA) particles (trade name: TECK POLYMER SSX-102 manufactured by SEKISUI PLASTICS Co., Ltd., average primary particle diameter: 2.5 μm) were added thereto and stirred to prepare a conductive layer-forming coating liquid.

The prepared conductive layer-forming coating liquid was applied onto an aluminum cylinder having an outer diameter of 19.9 mm and a length of 261 mm by dip coating to form a coating film. The coating film was dried by performing heating at 170° C. for 30 minutes to form a conductive layer having a thickness of 30 μm.

Subsequently, 2 parts of polyvinyl butyral (trade name: S-LEC BX-1 manufactured by Sekisui Chemical Co., Ltd.) was dissolved in 100 parts of cyclohexanone. To this solution, 4 parts of a hydroxygallium phthalocyanine crystal (charge generation material) having peaks at Bragg angles 2θ±0.2° of 7.4° and 28.1° in CuKα characteristic X-ray diffraction and 0.04 parts of a compound represented by formula (A) below were added.

(A)

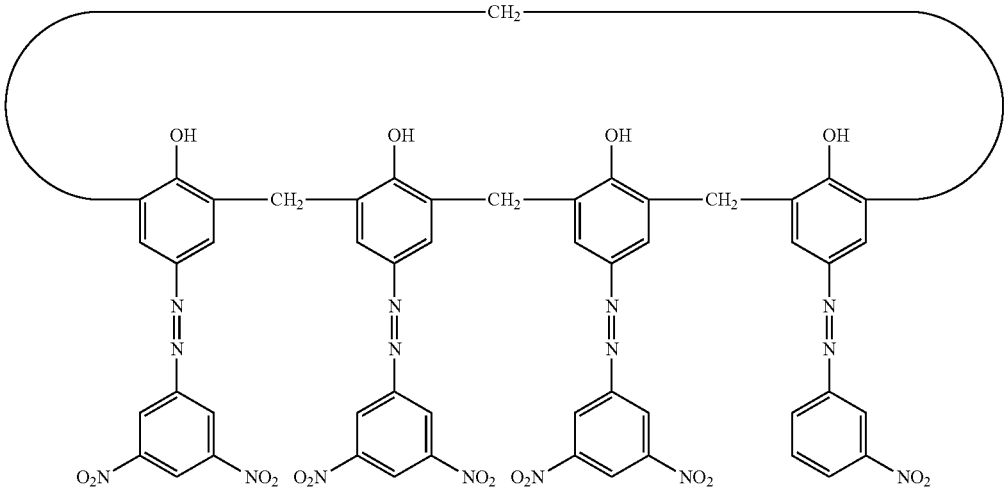

The mixture was inserted into a sand mill that uses glass beads having a diameter of 1 mm, and dispersed at 23±3° C. for one hour. After the dispersion, 100 parts of ethyl acetate was added thereto and thus a charge generating layer-forming coating liquid was prepared. The charge generating layer-forming coating liquid was applied onto the conductive layer by dip coating to form a coating film. The coating film was dried at 90° C. for 10 minutes to form a charge generating layer having a thickness of 0.20 μm.

Next, 90 parts of an amine compound (charge transport material (hole transport material)) represented by formula (B) below, (B)

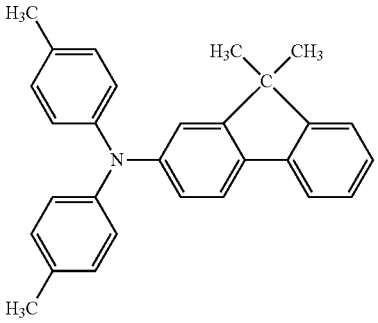

10 parts of an amine compound (charge transport material (hole transport material)) represented by formula (C) below, and (C)

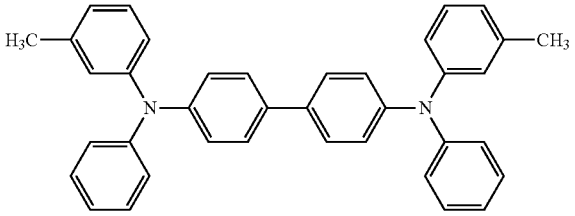

110 parts of a polyester resin having a structural unit represented by formula (D) below (weight-average molecular weight Mw: 120,000) were dissolved in a mixed solvent of 650 parts of chlorobenzene and 150 parts of dimethoxymethane to prepare a charge transporting layer-forming coating liquid.

(D)

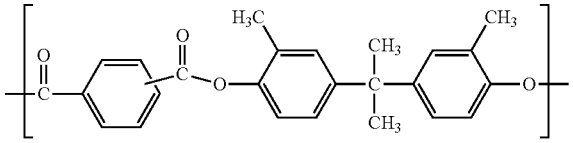

The charge transporting layer-forming coating liquid was left to stand for one day. The charge transporting layer-forming coating liquid was applied onto the charge generating layer by dip coating to form a coating film. The coating film was dried at 110° C. for 30 minutes to form a charge transporting layer having a thickness of 21 μm. In the polyester resin having the structural unit represented by the formula (D), the molar ratio of a terephthalic acid structure and an isophthalic acid structure (terephthalic acid skeleton: isophthalic acid skeleton) was 5:5.

Thus, an electrophotographic photosensitive member 1 was produced.

Production Example of Electrophotographic Photosensitive Member 2

An electrophotographic photosensitive member 2 was produced by forming the charge transporting layer in the same manner as in Production Example of the electrophotographic photosensitive member 1, except that the polyester resin having the structural unit represented by the formula (D) was changed to 125 parts of a polycarbonate (trade name: Iupilon 2400, manufactured by MITSUBISHI GAS CHEMICAL COMPANY, INC.) having a structural unit shown below.

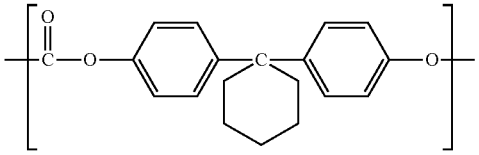

Production Example of Electrophotographic Photosensitive Member 3

An electrophotographic photosensitive member 3 was produced in the same manner as in Production Example of the electrophotographic photosensitive member 1, except that an undercoat layer was formed on the conductive layer of the electrophotographic photosensitive member 1 as follows.

Eight parts of an example compound A101, 10 parts of an isocyanate compound (B1) blocked with the group represented by the formula (1), 0.1 parts of zinc octoate (II), and 2 parts of a butyral resin (KS-5, manufactured by SEKISUI CHEMICAL CO., LTD.) were dissolved in a mixed solvent of 100 parts of dimethylacetamide and 100 parts of methyl ethyl ketone to prepare an undercoat layer-forming coating liquid. The undercoat layer-forming coating liquid was applied onto the conductive layer by dip coating to form a coating film. The coating film was cured (polymerized) by performing heating at 160° C. for 30 minutes to form an undercoat layer having a thickness of 0.5 μm.

Production Example of Electrophotographic Photosensitive Member 4

An electrophotographic photosensitive member 4 was produced in the same manner as in Production Example of the electrophotographic photosensitive member 1, except that an undercoat layer was formed on the conductive layer of the electrophotographic photosensitive member 1 as follows.

Three parts of N-methoxymethylated nylon and 3 parts of copolymer nylon were dissolved in a mixed solvent of 65 parts of methanol and 30 parts of n-butanol to prepare an undercoat layer-forming coating liquid. The undercoat layer-forming coating liquid was applied onto the conductive layer by dip coating, and dried at 80° C. for 10 minutes to form an undercoat layer having a thickness of 0.7 μm.

Production Example of Electrophotographic Photosensitive Member 5

An electrophotographic photosensitive member 5 was produced in the same manner as in Production Example of the electrophotographic photosensitive member 1, except that the conductive layer of the electrophotographic photosensitive member 1 was changed to a conductive layer described below.

After 200 g of titanium oxide particles (average particle diameter of primary particles: 200 nm) were dispersed in 3 L of water, 208 g of sodium stannate ($Na_2SnO_3$) having a tin content of 41% was added thereto and dissolved therein to prepare a mixture slurry. The neutralization of tin was performed by adding a 20% dilute sulfuric acid solution to the mixture slurry while circulating the mixture slurry and irradiating the mixture slurry with ultrasonic waves (40 kHz, 570 W). The dilute sulfuric acid solution was added for 98 minutes until the pH of the mixture slurry reached 2.5. After the neutralization, aluminum chloride (8 mol % based on Sn) was added to the mixture slurry, and the mixture slurry was stirred. Thus, a precursor of intended conductive particles was obtained. The precursor was washed with warm water and then subjected to cake filtration. The cake of the precursor collected by the filtration was placed in a horizontal tube furnace, and reduced by performing firing in a 2 vol % $H_2/N_2$ atmosphere at 500° C. for 1 hour. Thus, intended conductive particles 3 were obtained.

Next, 219 parts of the conductive particles 3, 146 parts of a phenolic resin (trade name: PLYOPHEN J-325, manufactured by DIC Corporation, resin solid content: 60%), and 106 parts of 1-methoxy-2-propanol serving as a solvent were inserted into a sand mill that uses 420 parts of glass beads having a diameter of 1.0 mm. A dispersion treatment was performed under the conditions of rotational speed: 2000 rpm, dispersion treatment time: 4 hours, and setting temperature of cooling water: 18° C. Thus, a dispersion liquid was prepared. The glass beads were removed from the dispersion liquid using a mesh. Subsequently, 23.7 parts of silicone resin particles (trade name: Tospearl 120, manufactured by Momentive Performance Materials Inc., average particle diameter: 2 μm) serving as a surface roughening material, 0.024 parts of silicone oil (trade name: SH28PA) serving as a leveling agent, 6 parts of methanol, and 6 parts of 1-methoxy-2-propanol were added to the dispersion liquid and stirred to prepare a conductive layer-forming coating liquid. The conductive layer-forming coating liquid was applied onto an aluminum cylinder by dip coating to form a coating film. The coating film was dried by performing heating at 150° C. for 30 minutes to form a conductive layer having a thickness of 30 μm.

Production Example of Electrophotographic Photosensitive Member 6

An electrophotographic photosensitive member 6 was produced by forming the charge transporting layer in the same manner as in Production Example of the electrophotographic photosensitive member 1, except that the polyester resin having the structural unit represented by the formula (D) was changed to a polyester resin having a structural unit shown below.

(E)

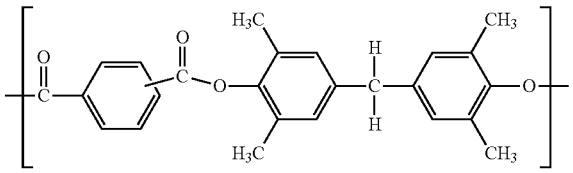

Evaluation

Fogging images formed in the repeated use were evaluated.

An HP Color LaserJet Enterprise CP4525n (process speed: 240 mm/sec, with pre-exposure device (electricity-removing unit)) manufactured by Hewlett-Packard Development Company L.P. was used as an evaluation apparatus. The evaluation apparatus was converted so as to include an electrophotographic photosensitive member having an outer diameter of 19.9 mm and so that a DC bias was applied to the electrophotographic photosensitive member from an external power supply. The evaluation apparatus was also converted so that the contact portions of a charging roller and the electrophotographic photosensitive member moved in the same direction and the peripheral speed difference was 110%. The produced electrophotographic photosensitive member was installed into a black station of a process cartridge. The evaluation was performed in an environment of 30° C. and 80% RH. The peripheral speed difference (110%) refers to a ratio of the peripheral speed of the charging roller to the peripheral speed of the electrophotographic photosensitive member.

A developing roller was also produced. The thickness of the developing roller was adjusted so as to have a contact pressure equal to that of a developing roller used in the evaluation apparatus, and the developing roller was installed into the evaluation apparatus.

Charging Roller A

Production of Charging Roller A

1. Preparation of Unvulcanized Rubber Composition

Materials listed in Table 5 below were mixed with each other in the amounts listed in Table 5 to prepare an unvulcanized rubber composition.

TABLE 5

| | |
|---|---|
| Epichlorohydrin-ethylene oxide-allyl glycidyl ether ternary copolymer (GECO) (trade name: Epichlomer CG-102 manufactured by DAISO CO., LTD.) | 100 parts by mass |
| Zinc oxide (Zinc Oxide Type II, manufactured by SEIDO CHEMICAL INDUSTRY CO., LTD.) | 5 parts by mass |
| Calcium carbonate (trade name: Silver-W, manufactured by SHIRAISHI CALCIUM KAISHA, LTD.) | 35 parts by mass |
| Carbon black (trade name: SEAST SO, manufactured by TOKAI CARBON CO., LTD.) | 0.5 parts by mass |
| Stearic acid | 2 parts by mass |
| Adipic acid ester (trade name: Polycizer W-305ELS, manufactured by DIC Corporation) | 10 parts by mass |
| Sulfur | 0.5 parts by mass |
| Dipentamethylenethiuram tetrasulfide (trade name: NOCCELER TRA, manufactured by OUCHI SHINKO CHEMICAL INDUSTRIAL CO., LTD.) | 2 parts by mass |
| Cetyltrimethylammonium bromide | 2 parts by mass |

2. Production of Conductive Elastic Roller

A round bar having a full length of 252 mm and an outer diameter of 6 mm was prepared by performing electroless nickel plating on the surface of a free-machining steel. An adhesive was then applied onto the entire perimeter in a central region having a length of 230 mm except for regions each having a length of 11 mm from the end portion of the round bar. The adhesive was a conductive hot-melt adhesive. The application was performed using a roll coater. In this Example, the round bar to which the adhesive was applied was used as a conductive mandrel.

Subsequently, a crosshead extruder including a supplying mechanism of the conductive mandrel and a discharging mechanism of unvulcanized rubber rollers was provided. A die having an inner diameter of 12.5 mm was attached to a crosshead. The temperatures of the extruder and the crosshead were set to 80° C., and the conveyance speed of the conductive mandrel was adjusted to 60 mm/sec. Under these conditions, the unvulcanized rubber composition was supplied from the extruder, and the conductive mandrel was coated with an elastic layer formed of the unvulcanized rubber composition in the crosshead to obtain an unvulcanized rubber roller. The unvulcanized rubber roller was inserted into an air heating furnace for vulcanization at 170° C. and heated for 60 minutes to obtain an unpolished conductive elastic roller. Subsequently, the end portions of the elastic layer was removed by cutting. Finally, the surface of the elastic layer was polished with a grindstone. Thus, a conductive elastic roller having a diameter of 9.9 mm at each position 90 mm from the central portion toward the end portion and having a diameter of 10.0 mm in the central portion was obtained.

3. Production of Coating Liquid 1

A coating liquid of a binder resin for forming the conductive layer of the charging roller was produced by the following method.

In a nitrogen atmosphere, 100 parts of a polyester polyol (trade name: P2010, manufactured by KURARAY CO., LTD.) was gradually added dropwise to 27 parts of a polymeric MDI (trade name: Millionate MR200, manufactured by Nippon Polyurethane Industry Co., Ltd.) in a reaction vessel while the temperature in the reaction vessel was kept at 65° C. After the completion of the dropwise addition, the reaction was caused to proceed at 65° C. for 2 hours. The resulting reaction mixture was cooled to room temperature to obtain an isocyanate group-terminated prepolymer 1 containing 4.3% of an isocyanate group.

Preparation of Coating Liquid 1

Into 54.9 parts of the isocyanate group-terminated prepolymer 1, 41.52 parts of a polyester polyol (trade name: P2020, manufactured by KURARAY CO., LTD.) and 15 parts of carbon black (TOKABLACK #7360SB, manufactured by TOKAI CARBON Co., Ltd.) were mixed under stirring.

Subsequently, methyl ethyl ketone (hereafter referred to as "MEK") was added so that the total solid content was 30 mass %, and then the mixture was stirred with a paint shaker for 12 hours. The viscosity was adjusted to 8 cps using MEK to prepare a coating liquid 1.

4. Production of Charging Roller

The conductive elastic roller produced in the process 2 was dipped into the coating liquid 1 prepared in the process 3 once. Subsequently, the coating liquid 1 was air-dried at 23° C. for 30 minutes, dried in a hot-air circulating dryer at 90° C. for 1 hour, and then dried in the hot-air circulating dryer at 160° C. for 1 hour. Thus, a conductive layer was formed on the outer peripheral surface of the conductive elastic roller.

5. Evaluation of Characteristics

The produced conductive roller A had a volume resistivity of $3.3\times10^{10}$ Ω·cm and a surface hardness of 18.0 N/mm$^2$. The measurement methods thereof are described below.

5-1. Measurement of Volume Resistivity of Charging Roller

Figure 4:
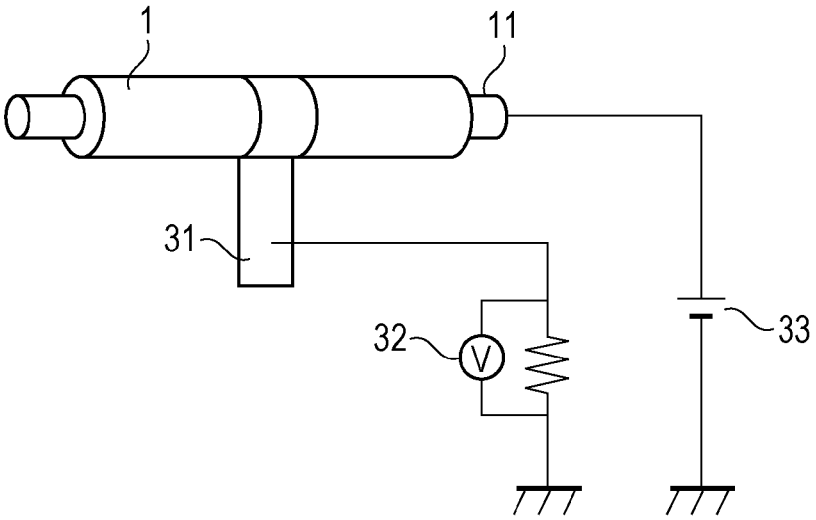
FIG. 4 illustrates a method for measuring the volume resistivity of the charging roller.

FIG. 4 schematically illustrates a resistance-measuring device. An aluminum sheet 31 having a width of 1.5 cm was wound in the central portion of a charging roller 1 so as to be in close contact with the charging roller 1 without any gap. In this state, a direct voltage was applied to a metal core 11 of the charging roller 1 using a power supply 32. The electrical resistance of the charging roller 1 was measured from the voltage across a resistor 33 connected to the aluminum sheet 31 in series. The electrical resistance of the charging roller 1 was measured by applying a direct voltage of 200V between the metal core 11 and the aluminum sheet 31 using the device illustrated in FIG. 4. Since the outer diameter of the roller was 10 mm, the width of the aluminum sheet was 1.5 cm, and the thickness of the charging roller was 2.0 mm, the volume resistivity (Pd) was determined from the measured electrical resistance (Ωd) using formula (4) below.

$$Pd=(\Omega d\times 1.0\times\pi\times 1.5)/0.20 \quad (4)$$

5-2. Measurement of Surface Hardness of Charging Roller

The surface hardness of the charging roller was measured with a universal hardness meter (trade name: Ultra-micro Hardness meter H-100V manufactured by Fisher Instruments). A quadrangular pyramid diamond was used as an indenter for measurement. The indentation speed was given by formula (5) below:

$$dF/dt=1000\ mN/240\ s \quad (5)$$

where F represents a force and t represents a time. The maximum hardness at an indentation depth of 1 μm was defined as the surface hardness of the charging roller.

Hereafter, the evaluation will be described. First, fogging images were evaluated.

A text image was printed on A4 plain paper at a printing ratio of each color of 1%. An image formed after full-color printing was continuously performed on 10000 sheets was evaluated. In the evaluation of fogging, a white solid image was printed on a partially covered sheet including a covered portion and an uncovered portion. The color density of the covered portion and the color density of the uncovered portion were measured with a reflection densitometer, and the ratio of the color density of the uncovered portion to the color density of the covered portion was defined as a fogging ratio. The following evaluation ranks were provided on the basis of the fogging ratio. A fogging ratio of more than 15% was judged to be a level at which the advantages of the present invention were not achieved.

A: The fogging ratio was 5% or less.

B: The fogging ratio was more than 5% and 10% or less.

C: The fogging ratio was more than 10% and 15% or less.

D: The fogging ratio was more than 15%.

Examples 1 to 16 and Comparative Examples 1 to 4

Table 6 collectively shows the combinations of the electrophotographic photosensitive members and the toners and the results of the evaluation. The evaluation apparatus in Example 1 included a pre-exposure device whereas the evaluation apparatus in Example 5 did not include a pre-exposure device. In Example 15, a peripheral speed difference was not generated between the charging device and the electrophotographic photosensitive member unlike Example 1, that is, the charging device was driven together with the electrophotographic photosensitive member.

Example 17

A conductive roller B was produced and used for evaluation in the same manner as in Example 13, except that the polyester polyol (trade name: P2020, manufactured by KURARAY CO., LTD.) used for the coating liquid 1 of the charging roller A used for evaluation was changed to a polyester polyol (trade name: P2010, manufactured by KURARAY CO., LTD.). The produced conductive roller B had a volume resistivity of $3.1\times10^8$ Ω·cm and a surface hardness of 1.5 N/mm$^2$.

Reference Example 1

The same evaluation as in Comparative Example 1 was performed, except that a cleaning blade was disposed in the evaluation apparatus of Comparative Example 1.

In this case, when the toner has a weight-average particle diameter of 7.1 μm or more and 10.0 μm or less, an average circularity of 0.95 or more, and an aspect ratio of 0.90 or more, an electrophotographic apparatus that does not cause fogging can be provided.

TABLE 6

| | | | Pre-exposure device | Charging roller | Fogging after printing of 10000 sheets |
|---|---|---|---|---|---|
| Example 1 | Toner 1 | Electrophotographic photosensitive member 1 | Yes | A | A |
| Example 2 | Toner 1 | Electrophotographic photosensitive member 2 | Yes | A | A |
| Example 3 | Toner 1 | Electrophotographic photosensitive member 3 | Yes | A | A |
| Example 4 | Toner 1 | Electrophotographic photosensitive member 4 | Yes | A | A |
| Example 5 | Toner 1 | Electrophotographic photosensitive member 4 | No | A | C |
| Example 6 | Toner 1 | Electrophotographic photosensitive member 5 | Yes | A | A |
| Example 7 | Toner 1 | Electrophotographic photosensitive member 3 | Yes | A | A |
| Example 8 | Toner 1 | Electrophotographic photosensitive member 5 | Yes | A | A |
| Example 9 | Toner 2 | Electrophotographic photosensitive member 6 | Yes | A | B |
| Example 10 | Toner 3 | Electrophotographic photosensitive member 1 | Yes | A | B |
| Example 11 | Toner 4 | Electrophotographic photosensitive member 1 | Yes | A | B |
| Example 12 | Toner 5 | Electrophotographic photosensitive member 1 | Yes | A | A |
| Example 13 | Toner 6 | Electrophotographic photosensitive member 1 | Yes | A | B |
| Example 14 | Toner 7 | Electrophotographic photosensitive member 1 | Yes | A | B |
| Example 15 | Toner 2 | Electrophotographic photosensitive member 1 | Yes | A | C |

TABLE 6-continued

| | | | Pre-exposure device | Charging roller | Fogging after printing of 10000 sheets |
|---|---|---|---|---|---|
| Example 16 | Toner 13 | Electrophotographic photosensitive member 1 | Yes | A | C |
| Example 17 | Toner 6 | Electrophotographic photosensitive member 1 | Yes | B | A |
| Comparative Example 1 | Toner 8 | Electrophotographic photosensitive member 6 | Yes | A | D |
| Comparative Example 2 | Toner 9 | Electrophotographic photosensitive member 6 | Yes | A | D |
| Comparative Example 3 | Toner 10 | Electrophotographic photosensitive member 6 | Yes | A | D |
| Comparative Example 4 | Toner 11 | Electrophotographic photosensitive member 6 | Yes | A | D |
| Comparative Example 5 | Toner 12 | Electrophotographic photosensitive member 6 | Yes | A | D |
| Reference Example 1 | Toner 8 | Electrophotographic photosensitive member 6 | Yes | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242581, filed Nov. 28, 2014, which is hereby incorporated by reference herein in its entirety.

What is claimed is:

1. A process cartridge detachably attachable to a main body of an electrophotographic apparatus, the process cartridge comprising:

a cylindrical electrophotographic photosensitive member;

a charging device that charges the electrophotographic photosensitive member; and a developing device that forms a toner image on the electrophotographic photosensitive member through development using a toner, wherein the electrophotographic photosensitive member comprises a surface layer comprising a polyarylate resin having a structural unit represented by formula (B), (B)

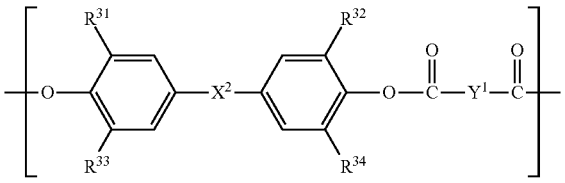

where $R^{31}$ to $R^{34}$ each independently represent a hydrogen atom or a methyl group; $X^2$ represents a single bond, a divalent group represented by formula (C) below, or a cyclohexylidene group; and $Y^1$ represents a m-phenylene group, a p-phenylene group, or a divalent group in which two p-phenylene groups are bonded to each other with an oxygen atom located therebetween, (C)

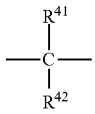

where $R^{41}$ and $R^{42}$ each independently represent a hydrogen atom, a methyl group, or a phenyl group, the electrophotographic photosensitive member has an outer diameter of 23 mm or less, the developing device is configured to collect a residual toner left on the electrophotographic photosensitive member after the toner image has been transferred onto a transfer material, the toner has a weight-average particle diameter (D4) of 7.1 μm or more and 10.0 μm or less, the toner has an average circularity of 0.95 or more, and the toner has an average aspect ratio of 0.90 or more.

2. The process cartridge according to claim 1, wherein the charging device is a charging roller, and the process cartridge comprises a driving force transmission that transmits a driving force which causes rotation so that contact portions of the electrophotographic photosensitive member and the charging roller move in the same direction and so as to generate a peripheral speed difference between the charging roller and the electrophotographic photosensitive member.

3. A process cartridge detachably attachable to a main body of an electrophotographic apparatus, the process cartridge comprising:

a cylindrical electrophotographic photosensitive member;

a charging device that charges the electrophotographic photosensitive member; and a developing device that forms a toner image on the electrophotographic photosensitive member through development using a toner, wherein the electrophotographic photosensitive member comprises a surface layer comprising a polycarbonate resin having a structural unit represented by formula (A), (A)

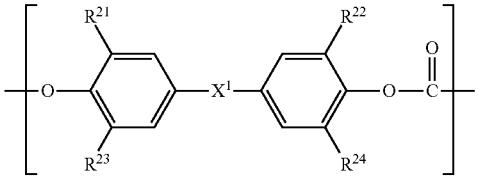

where $R^{21}$ to $R^{24}$ each independently represent a hydrogen atom or a methyl group, and $X^1$ represents a single bond, a cyclohexylidene group, or a divalent group represented by formula (C), (C)

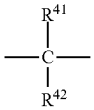

where $R^{41}$ and $R^{42}$ each independently represent a hydrogen atom, a methyl group, or a phenyl group, the electrophotographic photosensitive member has an outer diameter of 23 mm or less, the developing device is configured to collect a residual toner left on the electrophotographic photosensitive member after the toner image has been transferred onto a transfer material, the toner has a weight-average particle diameter (D4) of 7.1 μm or more and 10.0 μm or less, the toner has an average circularity of 0.95 or more, and the toner has an average aspect ratio of 0.90 or more.

4. The process cartridge according to claim 3, wherein the charging device is a charging roller, and the process cartridge comprises a driving force transmission that transmits a driving force which causes rotation so that contact portions of the electrophotographic photosensitive member and the charging roller move in the same direction and so as to generate a peripheral speed difference between the charging roller and the electrophotographic photosensitive member.

5. An image forming method comprising:

a step of charging a cylindrical electrophotographic photosensitive member with a charging device;

an electrostatic latent image-forming step of forming an electrostatic latent image on the charged electrophotographic photosensitive member;

a developing step of forming a toner image on the electrophotographic photosensitive member by developing the electrostatic latent image with a toner; and a transfer step of transferring the toner image formed on the electrophotographic photosensitive member onto a transfer material via an intermediate transfer body or without using an intermediate transfer body, wherein the electrophotographic photosensitive member comprises a surface layer comprising a polyarylate resin having a structural unit represented by formula (B), (B)

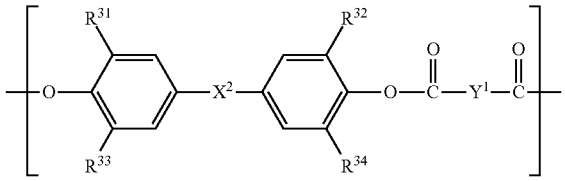

where $R^{31}$ to $R^{34}$ each independently represent a hydrogen atom or a methyl group; $X^2$ represents a single bond, a divalent group represented by formula (C), or a cyclohexylidene group; and $Y^1$ represents a m-phenylene group, a p-phenylene group, or a divalent group in which two p-phenylene groups are bonded to each other with an oxygen atom located therebetween, (C)

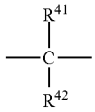

where $R^{41}$ and $R^{42}$ each independently represent a hydrogen atom, a methyl group, or a phenyl group, the electrophotographic photosensitive member has an outer diameter of 23 mm or less, in the developing step, a residual toner left on the electrophotographic photosensitive member after the transfer step is collected, the toner has a weight-average particle diameter (D4) of 7.1 μm or more and 10.0 μm or less, the toner has an average circularity of 0.95 or more, and the toner has an average aspect ratio of 0.90 or more.

6. The image forming method according to claim 5, wherein the charging device is a charging roller, and the image forming method comprises a step of transmitting a driving force which causes rotation so that contact portions of the electrophotographic photosensitive member and the charging roller move in the same direction and so as to generate a peripheral speed difference between the charging roller and the electrophotographic photosensitive member.

7. The image forming method according to claim 5, further comprising an electricity-removing step.

8. An image forming method comprising:

a step of charging a cylindrical electrophotographic photosensitive member with a charging device;

an electrostatic latent image-forming step of forming an electrostatic latent image on the charged electrophotographic photosensitive member;

a developing step of forming a toner image on the electrophotographic photosensitive member by developing the electrostatic latent image with a toner; and a transfer step of transferring the toner image formed on the electrophotographic photosensitive member onto a transfer material via an intermediate transfer body or without using an intermediate transfer body, wherein the electrophotographic photosensitive member comprises a surface layer comprising a polycarbonate resin having a structural unit represented by formula (A), (A)

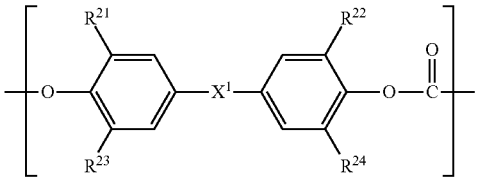

where $R^{21}$ to $R^{24}$ each independently represent a hydrogen atom or a methyl group, and $X^1$ represents a single bond, a cyclohexylidene group, or a divalent group represented by formula (C), (C)

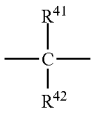

where $R^{41}$ and $R^{42}$ each independently represent a hydrogen atom, a methyl group, or a phenyl group, the electrophotographic photosensitive member has an outer diameter of 23 mm or less, in the developing step, a residual toner left on the electrophotographic photosensitive member after the transfer step is collected, the toner has a weight-average particle diameter (D4) of 7.1 μm or more and 10.0 μm or less, the toner has an average circularity of 0.95 or more, and the toner has an average aspect ratio of 0.90 or more.

9. The image forming method according to claim 8, wherein the charging device is a charging roller, and the image forming method comprises a step of transmitting a driving force which causes rotation so that contact portions of the electrophotographic photosensitive member and the charging roller move in the same direction and so as to generate a peripheral speed difference between the charging roller and the electrophotographic photosensitive member.

10. The image forming method according to claim 8, further comprising an electricity-removing step.

* * * * *